US009707610B2

(12) United States Patent
Nozu

(10) Patent No.: US 9,707,610 B2
(45) Date of Patent: Jul. 18, 2017

(54) PIPE BEND DIE UNIT, AND PIPE BENDING APPARATUS HAVING THE UNIT

(71) Applicant: SANGO CO., LTD., Miyoshi-shi, Aichi-ken (JP)

(72) Inventor: Kentaro Nozu, Nagakute (JP)

(73) Assignee: SANGO CO., LTD., Miyoshi-Shi, Aichi-Ken (JP)

( * ) Notice: Subject to any disclaimer, the term of this patent is extended or adjusted under 35 U.S.C. 154(b) by 0 days.

(21) Appl. No.: 15/033,460

(22) PCT Filed: Nov. 13, 2015

(86) PCT No.: PCT/JP2015/081923

§ 371 (c)(1),
(2) Date: Apr. 29, 2016

(87) PCT Pub. No.: WO2016/103963

PCT Pub. Date: Jun. 30, 2016

(65) Prior Publication Data

US 2016/0354822 A1 Dec. 8, 2016

(30) Foreign Application Priority Data

Dec. 26, 2014 (JP) ..... 2014-263981

(51) Int. Cl.
*B21D 7/024* (2006.01)
*B21D 7/025* (2006.01)
*B21D 37/14* (2006.01)

(52) U.S. Cl.
CPC ..... *B21D 7/025* (2013.01); *B21D 7/024* (2013.01); *B21D 37/145* (2013.01)

(58) Field of Classification Search
CPC . B21D 9/05; B21D 9/055; B21D 7/00; B21D 7/02; B21D 7/024; B21D 7/025;
(Continued)

(56) References Cited

U.S. PATENT DOCUMENTS 3,155,139 A * 11/1964 Hautau ..... B21D 9/055 72/150
5,337,590 A 8/1994 Schuchert et al.
(Continued)

FOREIGN PATENT DOCUMENTS

DE 1947917 A1 * 4/1970 ..... B21D 7/02
JP 52-71368 A 6/1977
(Continued)

OTHER PUBLICATIONS

EPO Machine Translation of DE 1947917 A1, Apr. 1970.*
(Continued)

*Primary Examiner* — Moshe Wilensky
*Assistant Examiner* — Pradeep C Battula
(74) *Attorney, Agent, or Firm* — Buchanan Ingersoll & Rooney PC

(57) ABSTRACT

A pipe bend die unit includes a bend die that comprises a clamp member and a counter pressure member, wherein the clamp member has a first groove part of half-circular cross section and a fitting recess extending in a peripheral direction by a first predetermined length on a planar surface perpendicular to a rotary axis. A fitting protrusion of the counter pressure member is positioned in the fitting recess to form a pipe-receiving groove of half-circular cross section, so that the counter pressure member and the clamp member are hingedly connected to one another about the rotary axis so as to be rotated relative to each other. The fitting recess possesses width expanding end face areas, where a clearance between opposing end faces is enlarged in a predetermined distance range including at least a radially outer end portion, from the rotary axis toward a radial outside.

20 Claims, 18 Drawing Sheets

(58) Field of Classification Search
CPC . B21D 7/028; B21D 7/04; B21D 7/08; B21D 37/145
See application file for complete search history.

(56) References Cited

U.S. PATENT DOCUMENTS

| | | | | |
|---|---|---|---|---|
| 6,009,737 | A | 1/2000 | Bandy | |
| 6,651,475 | B1 * | 11/2003 | O'Donnell | B21D 7/024 72/157 |
| 7,360,385 | B1 * | 4/2008 | Wohlenhaus | B21D 7/024 72/149 |
| 7,980,108 | B2 * | 7/2011 | Zuber | B21D 7/02 72/149 |

FOREIGN PATENT DOCUMENTS

| | | | |
|---|---|---|---|
| JP | 11-512029 | A | 10/1999 |
| JP | 2004-009125 | A | 1/2004 |
| JP | 2008-246504 | A | 10/2008 |
| JP | 2010-167470 | A | 5/2010 |
| JP | 2012-055952 | A | 3/2012 |

OTHER PUBLICATIONS

International Search Report (PCT/ISA/210) issued on Dec. 15, 2015, by the Japanese Patent Office as the International Searching Authortiy for International Application No. PCT/JP2015/081923.
Written Opinion (PCT/ISA/237) issued on Dec. 15, 2015, by the Japanese Patent Office as the International Searching Authority for International Application No. PCT/JP2015/081923.
Office Action (Notice of Ground of Rejection) issued on Dec. 22, 2015, by the Japanese Patent Office in corresponding Japanese Patent Application No. 2015-561442, and an English Translation of the Office Action.
Notice of Allowance issued on Feb. 5, 2016 by the Japanese Patent Office in corresponding Japanese Patent Application No. 2015-561442, and an English Translation of Notice of Allowance.

* cited by examiner

PIPE BEND DIE UNIT, AND PIPE BENDING APPARATUS HAVING THE UNIT

TECHNICAL FIELD

The present invention relates to a pipe bend die unit that is appropriate for bending a pipe, and a pipe bending apparatus having the unit.

BACKGROUND ART

As for working to bend a pipe, various kinds of working such as press bending, compression bending, extract bending, draw bending and the like are known heretofore, among which a rotary draw bending is most popular. According to an ordinary rotary draw bending, a pipe is held by a clamp die against a bend die with a groove formed on its outer peripheral surface, and the bend die and clamp die are rotated, with the pipe being pressed toward the bend die by means of a pressure die, then the pipe is moved in a tangential direction, thereby to be bent along the groove of the bend die, as disclosed in the second column of Patent document 1, for example, and also disclosed in Patent document 2, in its paragraphs (0003)-(0006) and FIG. 11, wherein the bend die is described as a roll die.

In Patent document 2, with respect to a wiper or shoe provided for preventing a crinkling from being created on the inner side of a bent portion of the pipe, a specific wiper is proposed to do with wear or breakage caused by a sliding motion, as described in its paragraphs (0013) and (0014). Likewise, in Patent document 3, it is described in its paragraph (0005) as an object to provide a pipe bending apparatus having a wear resistance, being used for various kinds of pipes without causing a problem, and having a very long life without requiring adjusting operations very often, and such a pipe bending apparatus is proposed in its paragraph (0006) that is characterized in that the pipe bending apparatus has a bend die with its outer peripheral surface formed in a circular arc of a predetermined curvature to bend a pipe, a clamp member clamping the pipe with the bend die, and a wiper rotating the clamp member about the bend die to prevent a crinkling from being created when the pipe is bent, and that a tip end portion of the wiper in the rotating direction of the clamp member is extended along the curvature of the outer peripheral surface of the bend die beyond an initial point for bending the Pipe.

Furthermore, in Patent document 4, with respect to a method and apparatus for quickly and accurately changing die sets for different-sized tubing to be bent or for different types of tube bending operations, it is described in its page 7 that a preassembled die set has been devised for tube bending apparatus wherein the die set is comprised of a bend die, clamp die and pressure die adapted to be mounted on a spindle of a tube bending table, the improvement comprising first means releasably interconnecting the pressure die and clamp die to the bend die in predetermined, aligned relation to one another and to the bend die, and handling means for engaging the die set in order to simultaneously lift and remove said dies comprising each die set from the table. And, it is described in its page 8 that many tube bending operations require the use of a wiper die and mandrel, which may also provide a part of each preassembled die set when needed, and such an embodiment that the wiper die is joined to the bend die by a wiper die arm is disclosed in its page 15 and FIG. 6.

PRIOR ART DOCUMENT

Patent Document

Patent document 1: U.S. Pat. No. 5,337,590
Patent document 2:
Japanese Patent Laid-open Publication No. 2004-9125
Patent document 3:
Japanese Patent Laid-open Publication No. 2008-246504
Patent document 4:
Japanese Patent Laid-open Publication No. Hei-11-512029

SUMMARY OF THE INVENTION

Problems to be Solved by the Invention

Although it is configured to form the crinkling intentionally in Patent document 1, in order to prevent the crinkling from being created when the draw rotary bending is performed, a crinkling prevention is employed in general, so that the wiper is disposed in Patent documents 2, 3 and 4. Among them, each wiper as described in Patent documents 2 and 4 has a tip end portion formed into a wedge shape, and possible wear of the tip edge portion was concerned in Patent document 2, so that a counter measure has been considered. Particularly, there is a step along an initial line for bending the pipe, normally a line where a surface including a rotary axis of the bend die intersects an inner surface of a groove of the bend die, a crinkling resulted from the step cannot be avoided. In order to minimize this crinkling, it is necessary to maintain the wedge shape of the tip end portion of the wiper, especially necessary to make the tip end portion as thinner as possible, so that the wiper is fragile and lacks its durability. Furthermore, a periodic wear countermeasure is unavoidable, and frequent replacements are required. In addition, as an initial setting for the bending is difficult, skilled technique is required. Therefore, it is difficult to perform a large amount of bending operations continuously.

In contrast, according to Patent document 3, a wiper disclosed as one embodiment therein configures a part of a central die section out of bending die sections which were divided into three sections along a vertical direction, and it is formed with a recess portion of a circular arc cross section, as described in its Paragraphs (0025)-(0030). Consequently, it is described in its Paragraph (0032) that a tip end portion with an edge structure is not required, and that there will be no possibility for creating a step between the bend die and the wiper, the reason of which has not been explained. Supposing that, from a start to an end of bending operation applied to a pipe to be formed, out of the bending die sections divided into three sections along three planar surfaces parallel to a pipe axis, upper and lower side die sections perform the bending, and the central section performs as the wiper, thereby to perform separate operations, not only it is difficult to prevent the crinkling from being created, but also it is difficult to perform the bending operation appropriately. No disclosure can be found about a configuration for enabling a desired bending operation.

In the meantime, although it is described in Patent document 4 that the die set with the bend die, clamp die and pressure die being preassembled can be changed to perform bending operations in different forms, as described in its Page 11, a wiper die is not necessarily required. In other words, Patent document 4 focuses on a performance of changing dies, but never discloses such a die set that can change dies with the performance of appropriately preventing the crinkling from being created, nor discloses a pipe bend die unit that is appropriate for bending a pipe and a pipe bending apparatus having the pipe bend die unit.

Accordingly, it is an object of the present invention to provide a pipe bend die unit that can perform bending a pipe appropriately without creating a crinkling. And, it is another object of the present invention to provide a pipe bending apparatus having the pipe bend die unit which is appropriate for the bending.

It is a further object of the present invention to provide a pipe bend die unit that can perform bending a pipe appropriately without creating a crinkling, and perform changing dies easily, and to provide a pipe bending apparatus having the unit.

Means for Solving the Problems

To solve the above-described problems, the pipe bend die unit of the present invention comprises a bend die with a pipe-receiving groove of half-circular cross section formed on an outer peripheral surface of the bend die, the bend die being rotatable about a rotary axis, and the bend die comprises a clamp member having a first groove part of half-circular cross section on an outer peripheral surface of the clamp member with a fitting recess formed on the first groove part and extending in a peripheral direction by a first predetermined length on a planar surface perpendicular to the rotary axis, and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the fitting recess of the clamp member possessing width expanding end face areas, where a clearance between opposing end faces is enlarged in a predetermined distance range including at least a radially outer end portion, from the rotary axis toward a radial outside, and the counter pressure member and the clamp member being hingedly connected to one another about the rotary axis, and supported so as to be rotatable relative to each other about the rotary axis.

In the pipe bend die unit as described above, it may be so configured that one part of the fitting protrusion is located at a foreside in an advancing direction of the pipe relative to a position where a bending operation of the pipe is initiated, and that an other part of the fitting protrusion is located at a backside in the advancing direction of the pipe relative to the position where the bending operation of the pipe is initiated. Or, it may be so configured that a fitting portion of the fitting protrusion that is positioned in the fitting recess is located at a foreside in an advancing direction of the pipe relative to a position where a bending operation of the pipe is initiated, and that a mating portion at which the first groove part of the clamp member and the second groove part of the counter pressure member mate is located at a backside in the advancing direction of the pipe relative to the position where the bending operation of the pipe is initiated.

It may be so configured that the counter pressure member has an annular rotary support portion mounted to be rotatable about the rotary axis, and that a part of the rotary support portion forms the fitting protrusion, and that the rotary support portion possesses an outer peripheral surface, the outer peripheral surface of the rotary support portion being a curved surface forming a part of the pipe-receiving groove of half-circular cross section. Also, it may be so configured that the counter pressure member and the clamp member are hingedly connected by an axial member having a central axis passing through the fitting recess.

Furthermore, in the pipe bend die unit as described above, it may be so configured that the fitting recess of the clamp member possesses parallel end face areas, where the opposing end faces are parallel to a planar surface perpendicular to the rotary axis in a predetermined distance range including a radially inner end portion, and possesses the width expanding end face areas being continuous with the parallel end face areas, from the rotary axis toward the radial outside. The width expanding end face areas may be configured to be inclined by 2-5 degree relative to the planar surface perpendicular to the rotary axis.

Also, in the pipe bend die unit as described above, it may be so configured that the fitting protrusion of the counter pressure member possesses a contact surface contacting with the pipe, the contact surface having a width included within a range of 20-45 degree about the central axis of the pipe as viewed on a cross section perpendicular to the central axis of the pipe, when the pipe is positioned in the first groove part of half-circular cross section of the clamp member.

Furthermore, in the pipe bend die unit as described above, it may be so configured that a plurality of bend dies are stacked one over another about the rotary axis as a common axis, and the pipe bend die unit comprises a connecting support member for holding each of the plurality of bend dies on a planar surface parallel to the rotary axis. Particularly, it may be so configured that the plurality of bend dies comprise a plurality of members, at least two members of the plurality of members having engaging grooves parallel to the planar surface perpendicular to the rotary axis, and that the connecting support member has protrusions to be engaged with the engaging grooves, the plurality of bend dies being held, with the protrusions being engaged with the engaging grooves.

Also, the present invention is to provide a pipe bending apparatus that comprises a bend die having a groove of half-circular cross section on an outer peripheral surface of the bend die, the bend die being rotatable about a rotary axis, a clamp die for clamping a pipe to be bent with the groove of the bend die, and a pressure die for pressing the pipe toward the bend die, and that the bend die comprises a clamp member having a first groove part of half-circular cross section on an outer peripheral surface of the clamp member with a fitting recess formed on the first groove part and extending in a peripheral direction by a first predetermined length on a planar surface perpendicular to the rotary axis, and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the fitting recess of the clamp member possessing width expanding end face areas, where a clearance between opposing end faces is enlarged in a predetermined distance range including at least a radially outer end portion, from the rotary axis toward a radial outside, and the counter pressure member and the clamp member being hingedly connected to one another about the rotary axis, and supported so as to be rotatable relative to each other about the rotary axis, to configure a pipe bend die unit.

In the pipe bending apparatus as described above, it may be so configured that one part of the fitting protrusion is located at a foreside in an advancing direction of the pipe relative to a position where a bending operation of the pipe is initiated, and that an other part of the fitting protrusion is located at a backside in the advancing direction of the pipe relative to the position where the bending operation of the pipe is initiated. Or, it may be so configured that one part of the fitting protrusion is located at a foreside in an advancing direction of the pipe relative to a position where a bending operation of the pipe is initiated, and an other part of the fitting protrusion is located at a backside in the advancing direction of the pipe relative to the position where the bending operation of the pipe is initiated.

It may be so configured that the counter pressure member has an annular rotary support portion mounted to be rotatable about the rotary axis, and a body portion formed integrally with the rotary support portion, the second groove part of half-circular cross section and the curved surface portion being provided on the body portion, a part of the rotary support portion being formed integrally with the body portion and extending outwardly in a radial direction of the rotary support portion, and that the rotary support portion forms the fitting protrusion, and the rotary support portion possesses an outer peripheral surface, the outer peripheral surface of the rotary support portion being a curved surface forming a part of the pipe-receiving groove of half-circular cross section.

Also, in the pipe bending apparatus as described above, it may be so configured that the fitting recess of the clamp member possesses parallel end face areas, where the opposing end faces are parallel to a planar surface perpendicular to the rotary axis in a predetermined distance range including a radially inner end portion, and possesses the width expanding end face areas being continuous with the parallel end face areas, from the rotary axis toward the radial outside.

Furthermore, in the pipe bending apparatus as described above, it may be so configured that a plurality of bend dies are stacked one over another about the rotary axis as a common axis, and the pipe bend die unit comprises a connecting support member for holding each of the plurality of bend dies on a planar surface parallel to the rotary axis. Particularly, it may be so configured that the plurality of bend dies comprise a plurality of members, at least two members of the plurality of members having engaging grooves parallel to the planar surface perpendicular to the rotary axis, and that the connecting support member has protrusions to be engaged with the engaging grooves, the plurality of bend dies being held, with the protrusions being engaged with the engaging grooves. Furthermore, it may be so configured that the first groove part formed on each clamp member of the plurality of bend dies possesses a sectional view formed to be different from each other depending upon forming states of the pipe.

In the pipe bending apparatus as described above, it may further comprise a mandrel with a tip end portion thereof being inserted into the pipe, the mandrel being driven such that the tip end portion opposes the pressure die within a predetermined rotating region of the bend die.

Effects of the Invention

As the present invention is configured as described above, the following effects can be achieved. That is, according to the pipe bend die unit of the present invention, the bend die configuring it comprises a clamp member having a first groove part of half-circular cross section on an outer peripheral surface of the clamp member with a fitting recess formed on the first groove part and extending in a peripheral direction by a first predetermined length on a planar surface perpendicular to the rotary axis, and a counter pressure member having a second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the fitting recess of the clamp member possessing width expanding end face areas, where a clearance between opposing end faces is enlarged in a predetermined distance range including at least a radially outer end portion, from the rotary axis toward the radial outside, and the counter pressure member and the clamp member being hingedly connected to one another about the rotary axis, and supported so as to be rotatable relative to each other about the rotary axis. Therefore, the bending of the pipe can be achieved appropriately without causing the crinkling.

Particularly, as the above-described fitting recess possesses the width expanding end face areas, when the relative rotating motion between the clamp member and the counter pressure member occurs, a partial sliding motion may be caused between them, so that a smooth operation can be ensured. In addition, as a good oil retention effect can be obtained between the clamp member and the counter pressure member, durability of the clamp member and the counter pressure member will be improved. The width expanding end face areas may be formed into tapered surfaces or curved surfaces. Furthermore, if a plurality of pipe bend die units are prepared in accordance with various shapes of pipes to be bent, when a pipe is to be bent in a shape, a pipe bend die unit for the shape to be bent may be simply selected and changed, so that may be provided such a pipe bend die unit that die change can be performed easily, and that no adjustment is required after the die change.

In the pipe bend die unit as described above, if such a configuration is employed that one part of the fitting protrusion is located at a foreside in an advancing direction of the pipe relative to a position where a bending operation of the pipe is initiated, and an other part of the fitting protrusion is located at a backside in the advancing direction of the pipe relative to the position where the bending operation of the pipe is initiated, or if such a configuration is employed that a fitting portion of the fitting protrusion positioned in the fitting recess is located at a foreside in an advancing direction of the pipe relative to a position where a bending operation of the pipe is initiated, and a mating portion at which the first groove part of the clamp member and the second groove part of the counter pressure member mate is located at a backside of the advancing direction of the pipe relative to the position where the bending operation of the pipe is initiated, smooth bending of the pipe can be achieved without causing the crinkling.

Also, if the counter pressure member is formed to have an annular rotary support portion mounted to be rotatable about the rotary axis, it can be surely supported to be rotatable about the rotary axis, and it can be hingedly connected with the clamp member easily. Furthermore, if it is so configured that a part of the rotary support portion forms the fitting protrusion, and that the rotary support portion possesses an outer peripheral surface, with the outer peripheral surface of the rotary support portion being a curved surface forming a part of the pipe-receiving groove of half-circular cross section, the counter pressure member can be formed as a single part with an appropriate shape. And, it can be so configured that the counter pressure member and the clamp member are hingedly connected by an axial member having a central axis passing through the fitting recess.

Furthermore, in the pipe bend die unit as described above, if it is so configured that the fitting recess of the clamp member possesses parallel end face areas, where the opposing end faces are parallel to a planar surface perpendicular to the rotary axis in a predetermined distance range including a radially inner end portion, and possesses the width expanding end face areas being continuous with the parallel end face areas, from the rotary axis toward the radial outside, when the relative rotating motion between the clamp member and the counter pressure member occurs, a partial sliding motion may be caused between them, so that a smooth operation can be ensured. In addition, as a good oil retention effect can be obtained between the clamp member and the counter pressure member, durability of the clamp member and the counter pressure member will be improved. Particularly, it is effective, in the case where the width expanding end face areas are configured to be inclined by 2-5 degree relative to the planar surface perpendicular to the rotary axis.

Also, in the pipe bend die unit as described above, if it is so configured that the fitting protrusion of the counter pressure member possesses a contact surface contacting with the pipe, the contact surface having a width included within a range of 20-45 degree about the central axis of the pipe as viewed on a cross section perpendicular to the central axis of the pipe, when the pipe is positioned in the first groove part of half-circular cross section of the clamp member, a pipe with a crinkling prevention effect and its appearance being balanced appropriately can be formed.

Furthermore, in the pipe bend die unit as described above, it is so configured that a plurality of bend dies are stacked one over another about the rotary axis as a common axis, and the pipe bend die unit comprises a connecting support member for holding each of a plurality of bend dies on a planar surface parallel to the rotary axis, the plurality of bend dies are firmly held in such a state that the plurality of bend dies are connected appropriately, so that bending of the plurality of pipes can be made simultaneously, and appropriately in accordance with each pipe, in a stable state. Particularly, if it is so configured that the plurality of bend dies comprise a plurality of members, at least two members of the plurality of members having engaging grooves parallel to the planar surface perpendicular to the rotary axis, and that the connecting support member has protrusions to be engaged with the engaging grooves, the plurality of bend dies being held, with the protrusions being engaged with the engaging grooves, the plurality of bend dies are firmly held by a so-called spigot joint structure with the protrusions being engaged with the engaging grooves, so that a deflection which may be caused on the fitting recess of each clamp member can be prevented appropriately, and a displacement of the width of each fitting recess at its outer side in the radial direction can be minimized.

And, the pipe bending apparatus according to the present invention comprises the pipe bend die unit configured as described before, a clamp die for clamping the pipe to be bent with the pipe-receiving groove of its bend die, and a pressure die for pressing the pipe toward the bend die, and bending of the pipe can be performed by rotating the bend die and the clamp die, with the pipe being pressed in the bending direction by the pressure die, so that the bending of the pipe can be achieved appropriately without causing the crinkling. Particularly, as the fitting recess of the clamp member possesses the width expanding end face areas, when a relative rotating motion occurs between the clamp member and the counter pressure member, a partial sliding motion may be caused between them, so that a smooth operation can be ensured. In addition, as a good oil retention effect can be obtained between the clamp member and the counter pressure member, durability of the clamp member and the counter pressure member will be improved. Furthermore, if a plurality of pipe bend die units are prepared in accordance with various shapes of pipes to be bent, when a pipe is to be bent in a shape, a pipe bend die unit for the shape to be bent may be simply selected and changed, so that the die change can be performed easily, and that no adjustment is required after the die change. Therefore, an automatic die change by means of a robot can be made.

In the pipe bending apparatus as described above, if such a configuration is employed that one part of the fitting protrusion is located at a foreside in an advancing direction of the pipe relative to a position where a bending operation of the pipe is initiated, and an other part of the fitting protrusion is located at a backside in the advancing direction of the pipe relative to the position where the bending operation of the pipe is initiated, or a fitting portion of the fitting protrusion that is positioned in the fitting recess is located at a foreside in an advancing direction of the pipe relative to a position where a bending operation of the pipe is initiated, and a mating portion at which the first groove part of the clamp member and the second groove part of the counter pressure member mate is located at a backside in the advancing direction of the pipe relative to the position where the bending operation of the pipe is initiated, smooth bending of the pipe can be achieved without causing the crinkling.

If the counter pressure member served for the pipe bending apparatus as described above has an annular rotary support portion mounted to be rotatable about the rotary axis, it can be surely supported to be rotatable about the rotary axis, and it can be hingedly connected with the clamp member easily. In addition, if it is so configured to have a rotary support portion mounted to be rotatable about the rotary axis, and a body portion formed integrally with the rotary support portion, the second groove part of half-circular cross section and the curved surface portion being provided on the body portion, a part of the rotary support portion being formed integrally with the body portion and extending outwardly in a radial direction of the rotary support portion, the rotary support portion forming the fitting protrusion, and the outer peripheral surface of the rotary support portion being a curved surface forming a part of the pipe-receiving groove of half-circular cross section, the counter pressure member can be formed as a single part with an appropriate shape.

Also, in the pipe bending apparatus as described above, if it is so configured that the fitting recess of the clamp member possesses parallel end face areas, where the opposing end faces are parallel to a planar surface perpendicular to the rotary axis in a predetermined distance range including a radially inner end portion, and possesses the width expanding end face areas being continuous with the parallel end face areas, from the rotary axis toward the radial outside, when a relative rotating motion occurs between the clamp member and the counter pressure member, a partial sliding motion may be caused between them, so that a smooth operation can be ensured. In addition, as a good oil retention effect can be obtained between the clamp member and the counter pressure member, durability of the clamp member and the counter pressure member will be improved.

Furthermore, in the pipe bending apparatus as described above, if it is so configured that a plurality of bend dies are stacked one over another about the rotary axis as a common axis, and that the pipe bend die unit comprises a connecting support member for holding each of the plurality of bend dies on a planar surface parallel to the rotary axis, as the plurality of bend dies are firmly held in such a state that the plurality of bend dies are connected appropriately, so that bending of the plurality of pipes can be made simultaneously, and appropriately in accordance with each pipe, in a stable state. Particularly, if it is so configured that the plurality of bend dies comprise a plurality of members, at least two members of the plurality of members having engaging grooves parallel to the planar surface perpendicular to the rotary axis, and the connecting support member has protrusions to be engaged with the engaging grooves, and that the plurality of bend dies are held, with the protrusions being engaged with the engaging grooves, the plurality of bend dies are firmly held by a so-called spigot joint structure with the protrusions being engaged with the engaging grooves, so that a deflection which may be caused on the fitting recess of each clamp member can be prevented appropriately, and a displacement of the width of each fitting recess at its outer side in the radial direction can be minimized. Furthermore, if it is so configured that the first groove part formed on each clamp member of the plurality of bend dies possesses a sectional view formed to be different from each other depending upon forming states of the pipe, bending of a plurality of pipes with their clamped portions being different depending upon forming states of the pipes can be made simultaneously.

In the pipe bending apparatus as described above, if it comprises a mandrel with a tip end portion thereof being inserted into the pipe, to be driven such that the tip end portion opposes the pressure die within a predetermined rotating region of the bend die, bending operation with a small bending radius can be made easily, and limit for bending the pipe can be improved at a large extent.

EMBODIMENTS FOR CARRYING OUT THE INVENTION

Figure 1:
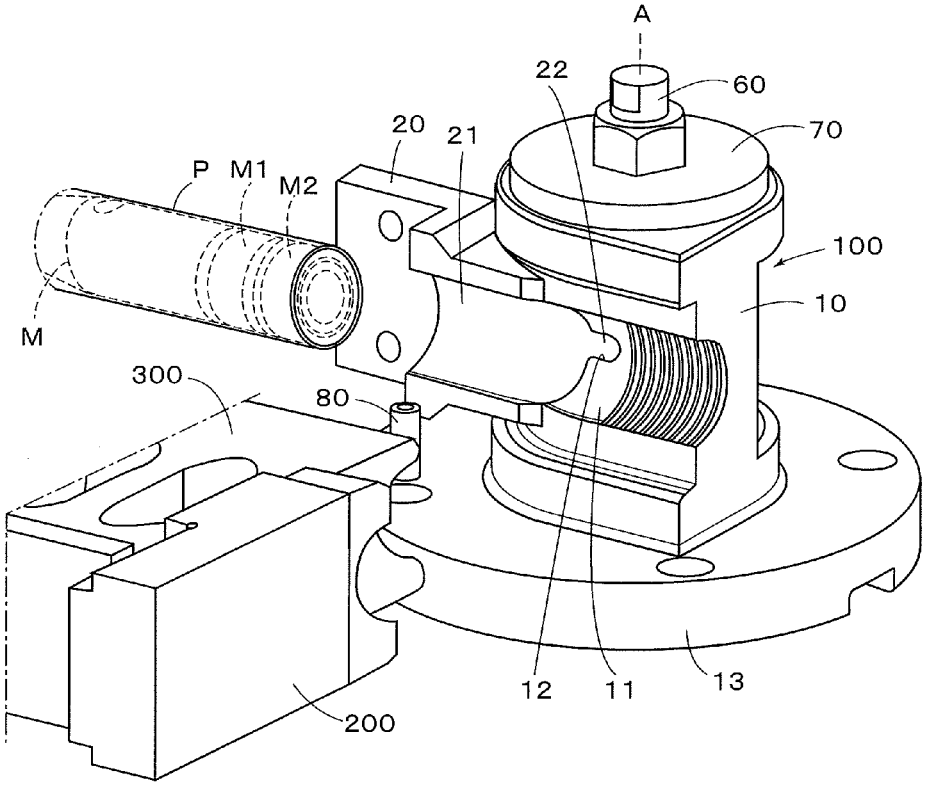
FIG. 1 is a perspective view showing a pipe bending apparatus according to an embodiment of the present invention.

Hereinafter, will be explained desirable embodiments of the present invention referring to drawings. FIG. 1 shows a pipe bend die unit according to an embodiment of the present invention, and shows a pipe bending apparatus further comprising a clamp die 200 and a pressure die 300 according to an embodiment of the present invention. The pipe bend die unit has a bend die 100, which is formed with a pipe-receiving groove of half-circular cross section (configured by first and second groove parts 11, 21 as will be described later), and which is rotated about a rotary axis (A). And, according to the pipe bending apparatus, it is so configured that a pipe (P) to be bent is clamped between the bend die 100 and the clamp die 200, and forwardly driven with being pressed toward the bend die 100 by the pressure die 300, thereby to bend the pipe (P) by means of compressing load and axially pressing load.

Figure 2:
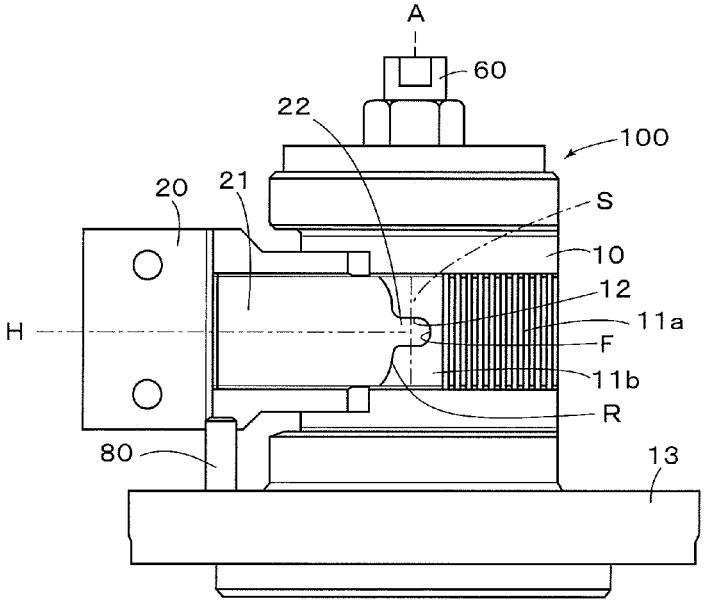
FIG. 2 is a front view of a pipe bend die unit according to an embodiment of the present invention.

According to the present embodiment, the bend die 100 has a clamp member 10 and a counter pressure member 20. As shown in FIGS. 1 and 2, the clamp member 10 is formed with the first groove part 11 of half-circular cross section, and a fitting recess 12 of a predetermined width is formed on the first groove part 11 to extend in a peripheral direction by a predetermined length on a planar surface perpendicular to the rotary axis (A). And, the clamp member 10 is formed integrally with a base portion 13, to which an axial member 60 is fixed so as to provide the rotary axis (A), and a holding member 70 is fixed to the clamp member 10. Furthermore, a knock pin 80 is fixed to a predetermined position of the base portion 13, as will be described later.

Figure 3:
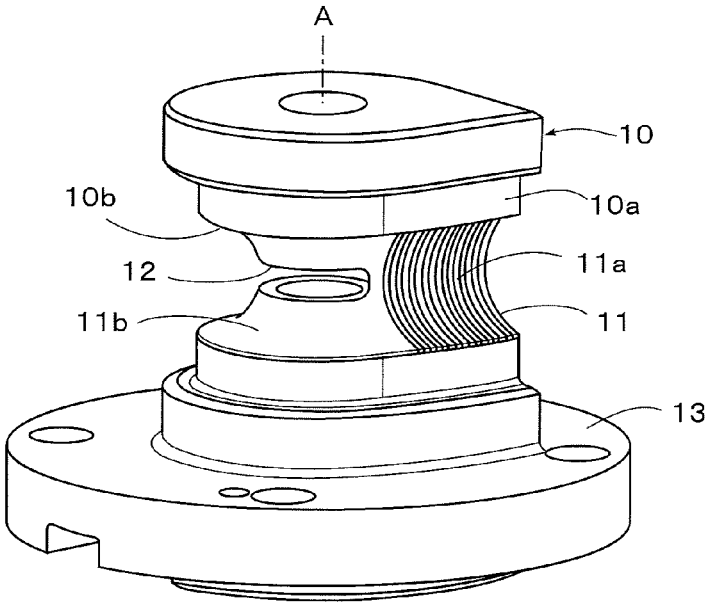
FIG. 3 is a perspective view showing a clamp member for use in a pipe bend die unit according to an embodiment of the present invention.

As shown in FIG. 3, the above-described clamp member 10 has a circularly recessed portion 10*b* to form the first groove part 11 of half-circular cross section, and the fitting recess 12 having a predetermined width and extending in a peripheral direction on a planar surface perpendicular to the rotary axis (A). The fitting recess 12 is located at the bottom center of the circularly recessed portion 10*b*. Accordingly, the first groove part 11 of half-circular cross section is continuous with the circularly recessed portion 10*b* including a part of the fitting recess 12. That is, the clamp member 10 has a clamp portion 10*a* for clamping the pipe (P), with a planar surface of the clamp portion 10*a* being connected to the clamp die 200, and the circularly recessed portion 10*b* formed continuously next to the clamp portion 10*a*, and a base portion 13 is formed integrally with the clamp portion 10*a* and the circularly recessed portion 10*b*.

Accordingly, the first groove part 11 possesses a continuous half-circular cross section, with a groove part 11*a* of half-circular cross section formed on the clamp portion 10*a* and a groove part 11*b* of half-circular cross section formed on the circularly recessed portion 10*b*. Furthermore, on the groove part 11*a*, a plurality of clamp grooves are formed peripherally in parallel to ensure holding the pipe (P), in the same manner as the inner peripheral surface of the clamp die 200.

Figure 5:
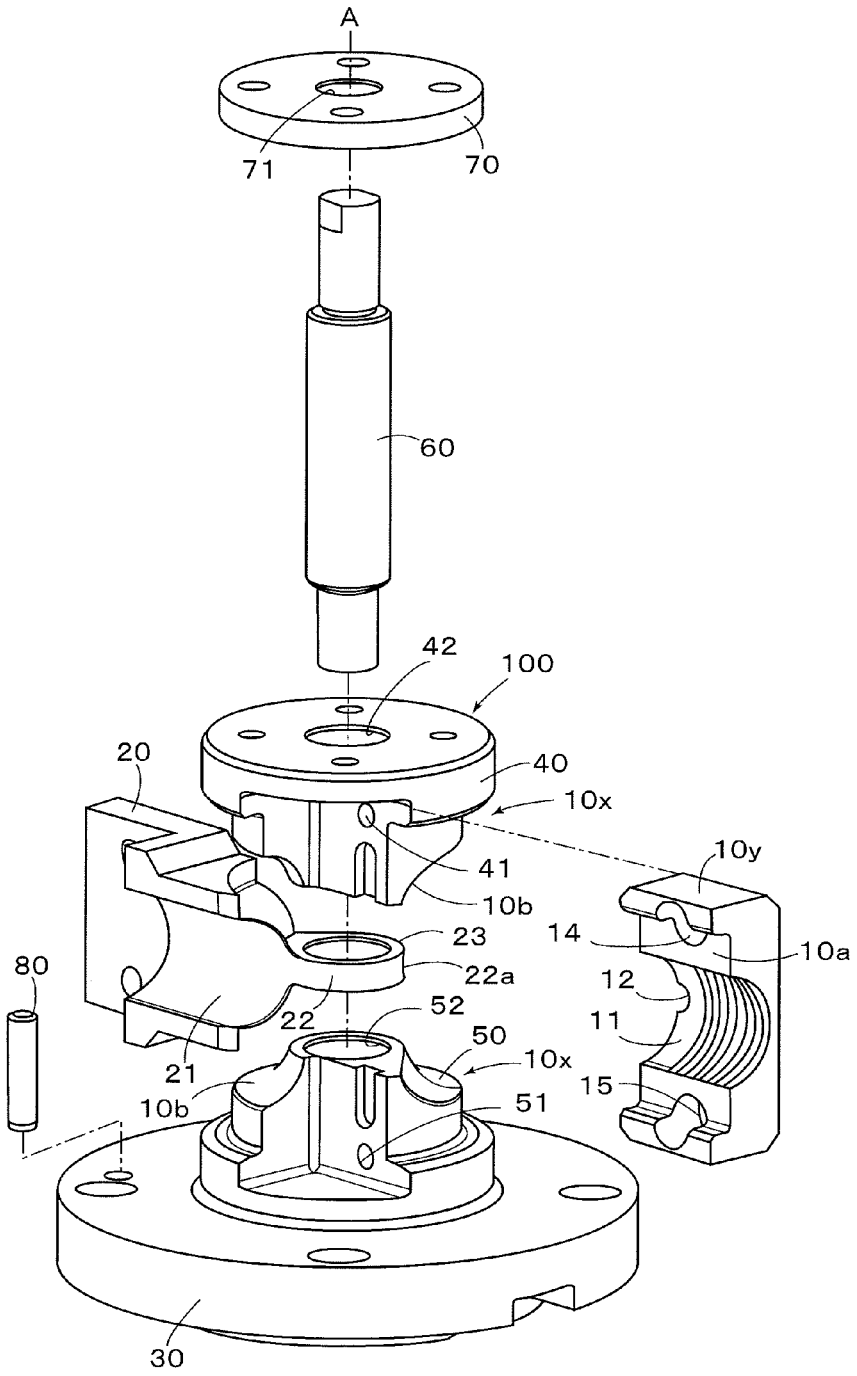
FIG. 5 is a perspective view of parts for assembling a pipe bend die unit according to an embodiment of the present invention.

In contrast to the clamp portion 10*a* that is formed integrally with the clamp member 10, the portion forming the clamp portion 10*a* is made as a separate body (indicated by "10*y*" in FIG. 5 and so on), and connected to a main body 10 (indicated by "10*x*" in FIG. 5 and so on) configuring the circularly recessed portion 10*b*. For example, as shown in FIG. 5, the main body 10*x* is configured by an upper section 40 and a lower section 50, which are divided by a surface perpendicular to the rotary axis (A), and connected to a clamp portion 10*y* of the separate body, thereby to configure the clamp member 10. That is, the axial member 60 is disposed to penetrate a center hole 42 of the upper section 40, the rotary support portion 23 of the counter pressure member 20 and a center hole 52 of the lower section 50, and, after an upper portion of the axial member 60 is penetrated through a center hole 71 of the holding member 70, the holding member 70 is fixed to the upper section 40. The clamp portion 10*y* is fixed to the main body 10*x* (the upper section 40 and lower section 50), with screws (not shown) being inserted from fixing holes 14 and 15, and meshed with screw holes 41 and 51 of the upper section 40 and lower section 50.

According to the embodiment as shown in FIG. 5, therefore, the clamp member 10 is configured by the main body 10*x*, which is configured by the upper section 40 and lower section 50, and the clamp portion 10*y*. The fitting recess 12 is configured by a cutout portion of the clamp portion 10*y*, and a clearance between the upper section 40 and lower section 50. With the fitting protrusion 22 of the counter pressure member 20 being positioned in the fitting recess 12, the bend die 100 is configured. Hereinafter, the clamp member 10 includes the one configured by the main body 10*x* and clamp portion 10*y*, except otherwise described specifically.

On the other hand, as shown in FIGS. 1 and 2, the counter pressure member 20 is formed with the second groove part 21 of half-circular cross section on its outer peripheral surface, and a fitting protrusion 22 extending in a peripheral direction by a predetermined length from a tip end portion of the second groove part 21. When the fitting protrusion 22 is positioned in the fitting recess 12, the pipe-receiving groove of half-circular cross section is formed by the combination of the first groove part 11 of the clamp member 10 and the second groove part 21 of the counter pressure member 20.

Figure 4:
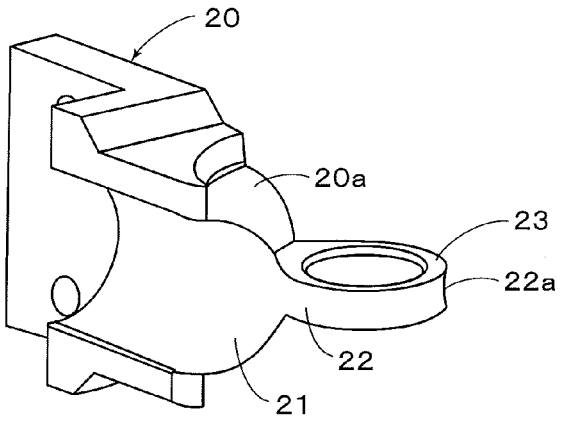
FIG. 4 is a perspective view showing a counter pressure member for use in a pipe bend die unit according to an embodiment of the present invention.

The above-described counter pressure member 20 is formed as shown in FIG. 4. That is, a curved surface portion (counter pressure portion) 20*a* positioned to be capable of contacting the circularly recessed portion 10*b* and the rotary support portion 23 rotatably supported about the rotary axis (A) are formed integrally, and a part of the rotary support portion 23 configures the fitting protrusion 22. Therefore, the outer peripheral surface of the rotary support portion 23 is formed into a curved surface, to form the pipe-receiving groove of half-circular cross section, together with the first groove part 11 of the clamp member 10. That is, the counter pressure member 20 is formed with a second groove part 21 of half-circular cross section, and the end surface of the second groove part 21 contacting the first groove part 11 of the clamp member 10 is formed to be curved according to its front view, as indicated by a contacting portion (R) in FIG. 2.

Figure 7:
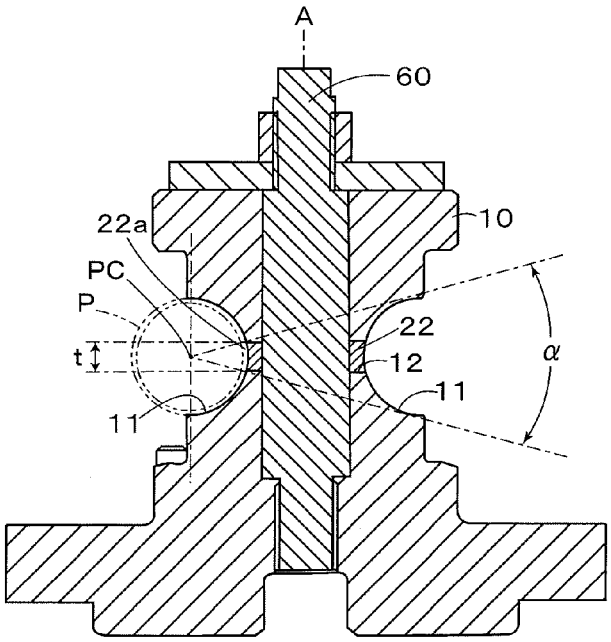
FIG. 7 is a sectional view of a clamp member for use in an embodiment of the present invention.
Figure 8:
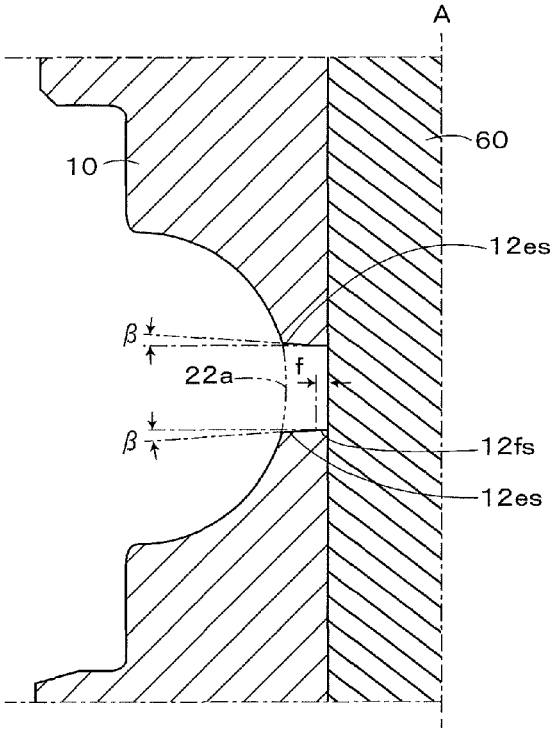
FIG. 8 is a sectional view of a clamp member with its fitting recess being enlarged for use in an embodiment of the present invention.

And, an outer peripheral surface 22*a* of the fitting protrusion 22, i.e., the outer peripheral surface of the rotary support portion 23 is formed into a curved surface as shown in FIGS. 7 and 8. When the fitting protrusion 22 is positioned in the fitting recess 12 of the clamp member 10, thereby to form a part of the half-circular cross section of the first groove part 11 of the clamp member 10, the pipe-receiving groove of half-circular cross section is formed by them. The rotary support portion 23 of the present embodiment is made in an annular shape, while it may be made in C-shape, with a portion except for the fitting protrusion 22 being cut out to provide a space.

The clamp member 10 and counter pressure member 20 as configured above are hingedly connected about the rotary axis (A), and rotatably supported relative to each other about the axial member 60 (rotary axis (A)). According to the present embodiment, the clamp member 10 is supported to be rotated against the counter pressure member 20, which is fixed to a predetermined position of a support device (not shown). As shown in FIG. 2, the clamp member 10 and the counter pressure member 20 are hingedly connected, such that a fitting portion (F) of the fitting recess 12 fitted with the fitting protrusion 22, which portion (F) is not included on planar surfaces perpendicular to the rotary axis (A), i.e., two planar surfaces parallel to the plane perpendicular to the paper surface of FIG. 2 including (H) shown in FIG. 2, is located at a foreside (right side of (S) in FIG. 2) in an advancing direction of the pipe (P) relative to an initial position (indicated by a vertical one-dotted chain line (S) in FIG. 2) where a bending operation of the pipe (P) is initiated, and a mating portion (R) of the first groove part 11 of the clamp member 10 and the second groove part 21 of the counter pressure member 20 in a rotating direction is located at a backside (left side of (S) in FIG. 2) of the advancing direction of the pipe (P). In other words, the fitting portion (F) of the fitting protrusion 22 positioned in the fitting recess 12 in a rotating direction is located at the foreside in an advancing direction of the pipe (P) relative to the position where the bending operation of the pipe (P) is initiated, and the mating portion (R) of the first groove part 11 of the clamp member 10 and the second groove part 21 of the counter pressure member 20 in the rotating direction is located at a backside of the advancing direction of the pipe (P) relative to the position where the bending operation of the pipe (P) is initiated.

As shown in FIG. 7, the fitting protrusion 22 of the counter pressure member 20 according to the present embodiment possesses a contact surface 22*a* contacting with the pipe (P) to be formed, with a width (t) of the contact surface 22*a* being included within a range (α) of 20-45 degree about the central axis (indicated by "PC" in FIG. 7) of the pipe (P) as viewed on a cross section perpendicular to the central axis (PC) of the pipe (P), when the pipe (P) is positioned in the first groove part 11 of half-circular cross section of the clamp member 10. The effect by this configuration will be described later referring to FIG. 27. The above-described width (t) is provided as the dimension that is included within the range (α) at the contact surface 22*a* contacting with the pipe (P), and it may be provided in such a manner that the cross-sectional width of fitting protrusion 22 is gradually reduced, or gradually increased, from the contact surface 22*a* toward the rotary axis (A), so that the cross section of the fitting recess 12 may be formed in accordance with that dimension.

On the other hand, according to the clamp member 10 with its enlarged sectional view being shown in FIG. 8, the fitting recess 12 possesses parallel end face areas (both end faces represented by "12*fs*" in FIG. 8), where the opposing end faces are parallel to a planar surface perpendicular to the rotary axis (A) (e.g., the planar surfaces parallel to the planar surface including (H) as shown in FIG. 2) in a predetermined distance range (indicated by "f" in FIG. 8) including a radially inner end portion, and possesses width expanding end face areas (both end faces represented by "12*es*" in FIG. 8) being continuous with the parallel end face areas (12*fs*), from the rotary axis (A) toward the radial outside. The width expanding end face areas (12*es*) as shown in FIG. 8 are formed to be tapered, and their inclined angles (β) relative to the parallel end face areas (12*fs*) are set to be 2-5 degree. The effect by this configuration will be described later with reference to FIG. 11. Instead, as enlarged in FIG. 9, width expanding end face areas (both end faces represented by "12*cs*") of curved surfaces may be formed.

Figure 9:
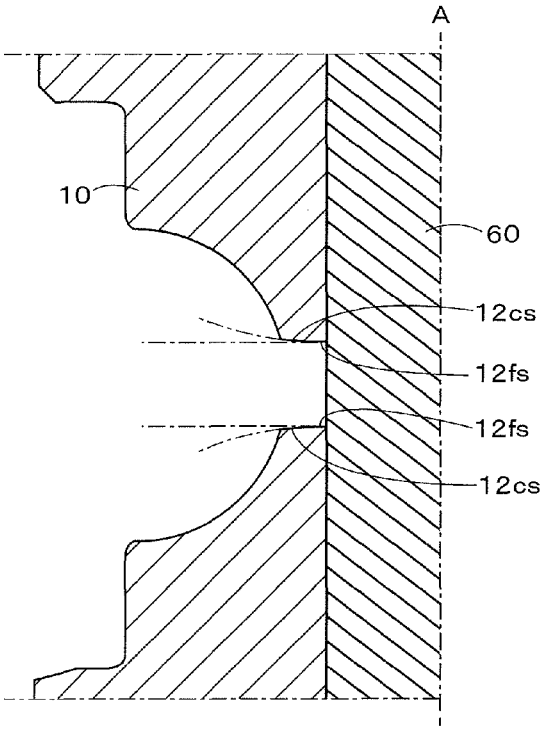
FIG. 9 is a sectional view of a clamp member with its another embodiment of the fitting recess being enlarged for use in an embodiment of the present invention.

When the above-described width expanding end face areas (12*es*, 12*cs*) are formed, the width expanding end face areas (12*es*) of tapered surfaces as shown in FIG. 8 can be made by a single cutting operation, whereas the width expanding end face areas (12*cs*) of curved surfaces as shown in FIG. 9 requires sequential cutting operations, so that the width expanding end face areas of tapered surfaces are preferable. Or, without providing the parallel end face areas (12*fs*), only width expanding end face areas (12*es*, 12*cs*) may be made by forming the tapered surfaces or curved surfaces from the radially inner end portion at the rotary axis (A) toward the radially outer end portion (i.e., whole area from the rotary axis (A) toward the radial outside), while its drawing is omitted herein.

With the fitting protrusion 22 of the counter pressure member 20 as configured above being assembled as shown in FIG. 5, and positioned in the fitting recess 12 of the clamp member 10, the axial member 60 configuring the rotary axis (A) is inserted through the rotary support portion 23 to be fixed to the base portion 13, and fixed to the holding member 70, thereby to configure the bend die 100 as shown in FIG. 1. Furthermore, a knock pin 80 is fixed to a predetermined position of the base portion 13 of the clamp member 10, so that an initial relative position between the clamp member 10 and the counter pressure member 20 is provided by a position where the counter pressure member 20 abuts on the knock pin 80. On the other hand, the clamp die 200 and the pressure die 300 are arranged as shown in FIG. 1, and disposed to be close to or away from the bend die 100, respectively.

As shown in FIGS. 1 and 2, therefore, as the pipe bend die unit is configured by the bend die 100 with the clamp member 10 and the counter pressure member 20 being placed at the initial relative position, if a plurality of pipe bend die units are provided for various shapes of the pipes (P) to be bent, in case of bending the various shapes of pipes, it is only required to select and change the bend die unit for the shape of the pipe to be bent, so that a so-called die change can be made easily. Particularly, as the initial relative position between the clamp member 10 and counter pressure member 20 can be set by the knock pin 80 in advance, no adjustment after the die change is required, so that it can be adjusted easily without any skilled technique. In addition to the pipe bend die unit as described above, if an assembly is configured by further comprising the clamp die 200 and pressure die 300, it is possible to provide a pipe bend die assembly for performing the die change and adjustment easily.

Figure 6:
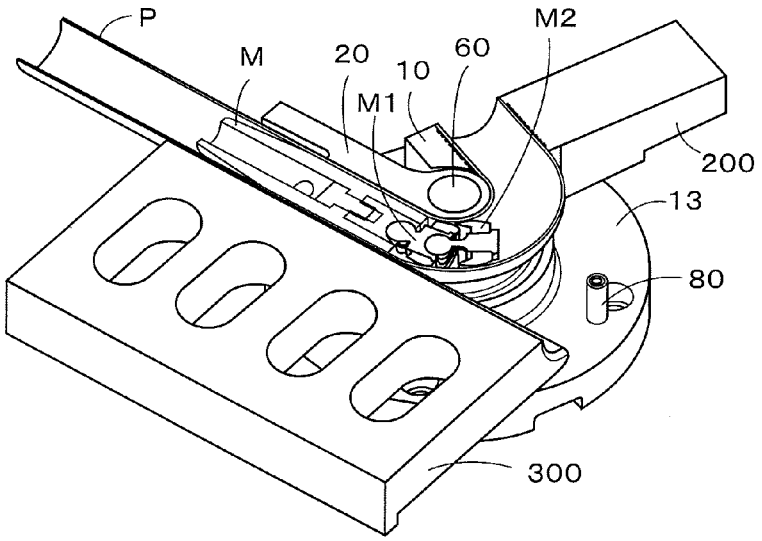
FIG. 6 is a perspective sectional view of a pipe bending apparatus showing its finishing state of a bending operation according to an embodiment of the present invention.

Referring to FIGS. 1-6, the overall operation of the pipe bending apparatus having the pipe bend die unit as described above will be explained hereinafter. At the outset, with the counter pressure member 20 being held at the initial relative position to contact the knock pin 80, a portion to be bent of the body portion of the pipe (P) is placed at the position ((S) in FIG. 2) of the bend die 100 where the bending operation is initiated, a known mandrel as indicated by (M) in FIGS. 1 and 6 is inserted into the pipe (P). The mandrel (M) has balls (M1) and (M2) pivotally mounted on its tip end portion, as its cross sectional view is shown in FIG. 6, where a hutching is omitted to define each part clearly. The balls (M1) and (M2) are inserted into the pipe (P), and driven to be disposed between the bend die 100 and the clamp die 200 (and pressure die 300) within a predetermined rotating region of the bend die 100. Next, the clamp die 200 and pressure die 300 are driven toward the bend die 100, the tip end portion of the pipe (P) is clamped between the clamp member 10 of the bend die 100 and the clamp die 200, and the body portion of the pipe (P) is compressed between the counter pressure member 20 of the bend die 100 and the pressure die 300.

Then, with the tip end portion of the pipe (P) being clamped between the clamp member 10 and the clamp die 200, the pipe (P) is forwardly driven, with the body portion of the pipe (P) being pressed to the counter pressure member 20 by the pressure die 300, and also the clamp die 200 and the clamp member 10 are rotated about the rotary axis (A), so that the pipe (P) is bent to be rolled around the outer peripheral surface of the rotary support portion 23 (the outer peripheral surface 22*a* of the fitting protrusion 22), thereby to form the pipe (P) bent in such a shape as shown in FIG. 6. During this operation, a large pressure is applied to the pipe (P) in its longitudinal direction and radial direction. With the pipe bend die unit according to the present embodiment being employed, however, the inner side wall of the bent pipe (P) is prevented from being thickened due to its compressed deformation, and the outer side wall of the bent pipe (P) is thickened and prevented from being thinned, so that an appropriate thickness of the pipe wall can be maintained even at the bent portion.

As described before, the bend die 100 served for the pipe bend die unit of the present embodiment comprises the clamp member 10 and counter pressure member 20, which are hingedly connected about the rotary axis (A), and rotatably supported relative to each other about the rotary axis (A). Therefore, as the pipe (P) is being bent, the clamp member 10 can be rotated relatively to the counter pressure member 20 about the rotary axis (A), with the counter pressure member 20 being pressed by the pressure die 300 through the pipe (P). Consequently, the clamp member 10 is rotated from the position ((S) in FIG. 2) where the bending operation of the pipe (A) is initiated, in a circumferential direction spaced from the counter pressure member 20.

Then, the counter pressure member 10 and the clamp member 20 are connected, such that the fitting portion (indicated by (F) in FIG. 2) of the fitting recess 12 fitted with the fitting protrusion 22, which portion is not included on planar surfaces perpendicular to the rotary axis (A), is located at the foreside in the advancing direction of the pipe (P) relative to the position (S) where the bending operation of the pipe (A) is initiated, and the mating portion (indicated by (R) in FIG. 2) of the first groove part 11 of the clamp member 10 and the second groove part 21 of the counter pressure member 20 in the rotating direction is located at the backside of the advancing direction of the pipe (A), whereby a step possibly caused between the clamp member 10 and counter pressure member 20 is made small. Therefore, even if relatively large longitudinal load and compressed load comparing with the prior art are applied to the pipe (P), a plastic deformation caused by bending it can be controlled appropriately, which will be described later in detail referring to FIGS. 28 and 29.

Figure 27:
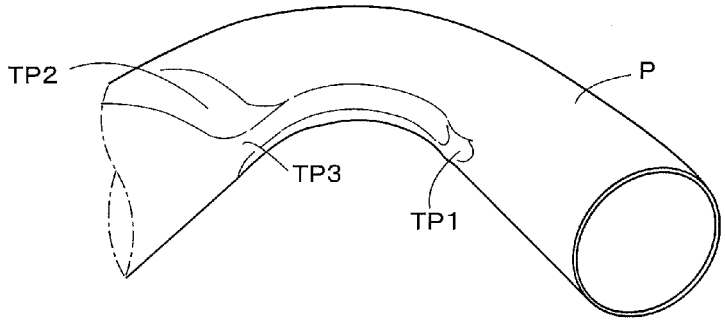
FIG. 27 is a perspective view showing a pipe which was bent by use of a pipe bend die unit according to an embodiment of the present invention.

Consequently, although the pipe (P) which was bent by use of the pipe bend die unit of the present embodiment is formed with a thick portion (protruded portion) as shown in FIG. 27 at a position corresponding to the fitting portion of the fitting recess 12 and the fitting protrusion 22, the portions next to the fitting portion will be formed in a smooth curved surface. Practically, thickness of a portion as indicated by a thin line in FIG. 27 is changed gradually, and deformed material is fitted into the fitting portion (indicated by (F) in FIG. 2) to form a thick portion (TP1), and thick portions (TP2 and TP3) along the mating portion (indicated by (R) in FIG. 2). However, the portion as indicated by the thin line in FIG. 27 is formed in a smooth curved surface, so that it does not correspond to the crinkling, and therefore, the thick portions (TP1, TP2 and TP3) may be ignored. Rather, the bent pipe with the thick portions (TP1, TP2 and TP3) being formed is proved to be the one which was formed by use of the pipe bend die unit of the present embodiment, to provide a proof of forming quality.

As described before, the fitting protrusion 22 of the counter pressure member 20 of the present embodiment has its thickness with the contact surface 22*a* being indicated by the width (t) in FIG. 7, and it has been confirmed that the pressing force applied to the pipe (P) to be bent is large when the width (t) of the contact surface 22*a* is within the range (α), and that the pressing force will be reduced squares to the width (t) as being away from the range (α) toward its outer side. As a result, a pipe with a crinkling prevention effect and its appearance being balanced appropriately can be formed. In contrast, provided that the width (t) of the contact surface 22*a* of the fitting protrusion 22 is set to be in a range smaller than 20 degree about the central axis (PC) of the pipe (P), for example, the thick portion (TP1) at the initiating side of the bending operation will become smaller and the thick portion (TP3) at the ending side of the bending operation will become larger, comparing with the shape as shown in FIG. 27, whereby its appearance may be good, but it will be difficult to control increasing the thickness, and difficult to suppress the crinkling. On the contrary, provided that the width (t) of the contact surface 22*a* of the fitting protrusion 22 is set to be in a range greater than 45 degree about the central axis (PC) of the pipe (P), for example, the thick portion (TP1) at the initiating side of the bending operation will become larger and the thick portion (TP3) at the ending side of the bending operation will become smaller, comparing with the shape as shown in FIG. 27, whereby the suppressing effect of the crinkling may be good, but the appearance of the product will be damaged.

As described above, according to the pipe bending apparatus having the pipe bend die unit of the present embodiment, a smooth bending can be achieved without causing a crinkling. In other words, by appropriately controlling the plastic forming caused by the bending operation appropriately, the bending of the pipe (P) can be achieved appropriately without causing the crinkling. Consequently, provided that a diameter of a pipe (P) is "d" and a bending radius is "r", for example, a pipe (P) with such an extraordinarily small bending radius that "r/d" is smaller than 1 can be easily formed. As an alternative to the aforementioned pipe bending apparatus, it may be so configured that the clamp member 10 is fixed, and that the counter pressure member 20 is rotated about the rotary axis (A). Furthermore, the pipe bend die unit can be used for an automatic pipe bending apparatus, and an automatic die change can be performed by a robot.

Figure 10:
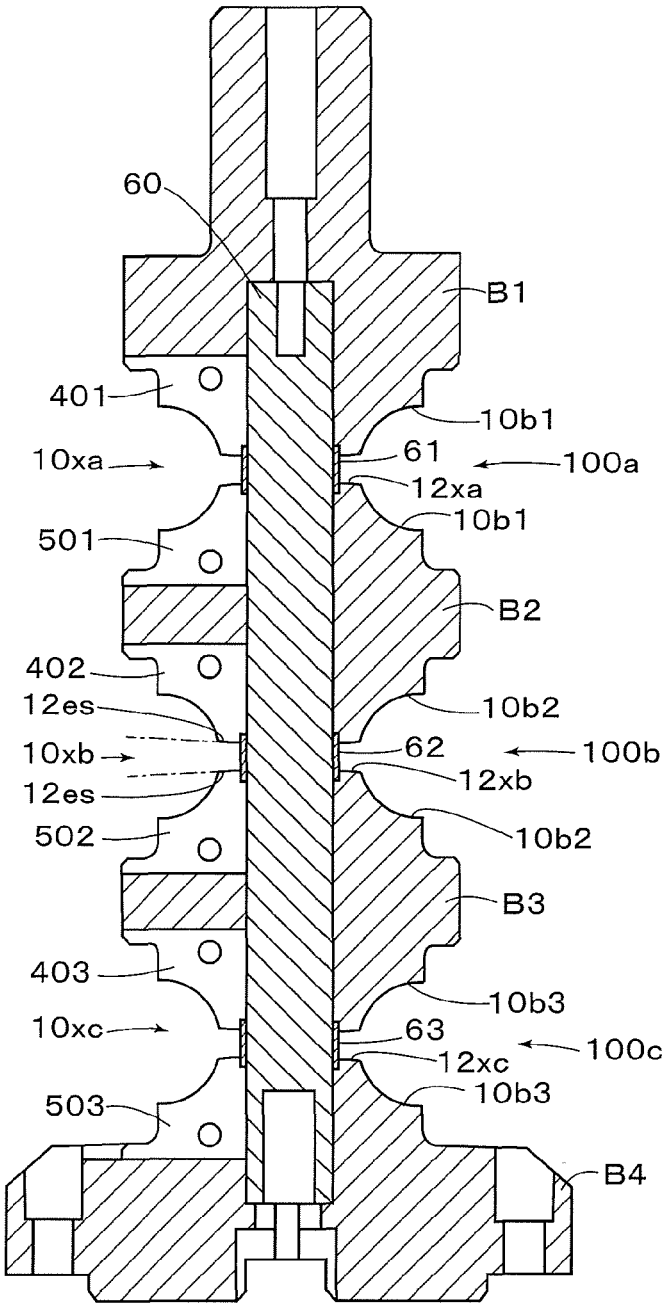
FIG. 10 is a sectional view of a clamp member for use in another embodiment of the present invention.
Figure 11:
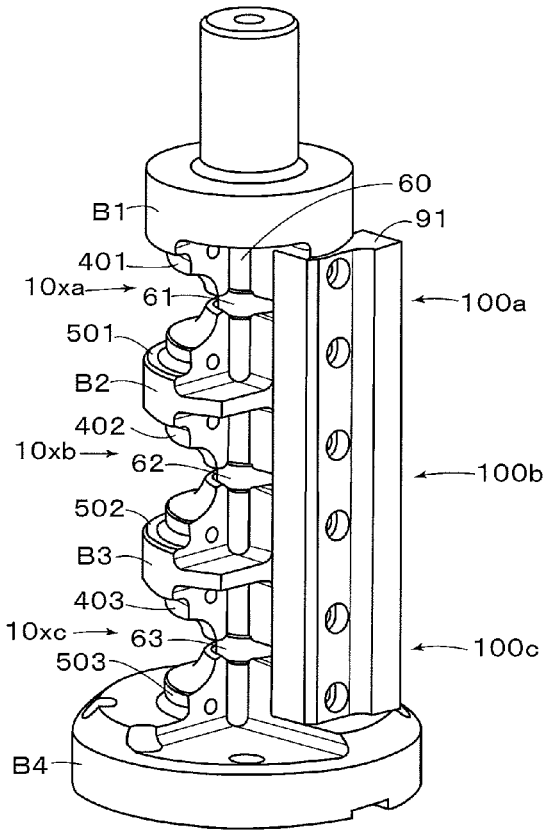
FIG. 11 is a perspective view of a clamp member, an axial member and a connecting support member for use in another embodiment of the present invention.

Next, with respect to the pipe bend unit, as shown in FIGS. 10 and 11, it may be configured that a plurality of bend dies 100*a*, 100*b* and 100*c* each having the above-described clamp member 10 and counter pressure member 20 may be stacked one over another, and supported to be rotatable about the rotary axis (A). The clamp member 10 and counter pressure member 20 for each die are hingedly connected about the rotary axis (A). Each of the bend dies 100*a*, 100*b* and 100*c* is formed into such an embodiment having the main body (10*x*) of the clamp member configured by the upper section 40 and lower section 50 as shown in FIG. 5, respectively, being stacked one over another to provide three layers.

According to the present embodiment, as apparent from FIG. 10, the main bodies 10*xa*, 10*xb* and 10*xc* of three clamp members are configured by four members B1-B4 (and the axial member 60). The main body 10*xa* is configured by an upper section 401 (a part of the member B1) and a lower section 501 (a part of the member B2). The main body 10*xb* is configured by an upper section 402 (a part of the member B2) and a lower section 502 (a part of the member B3). The main body 10*xc* is configured by an upper section 403 (a part of the member B3) and a lower section 503 (a part of the member B4). Circularly recessed portions 10*b*1, 10*b*2 and 10*b*3 are formed on the main bodies, respectively. Between the axial member 60 and bottoms of fitting recesses 12*xa*,

12*xb* and 12*xc*, bushes 61-63 are disposed, respectively. The main bodies 10*xa*, 10*xb* and 10*xc* are connected with clamp portions 10*ya*, 10*yb* and 10*yc*, which are omitted in FIG. 10, respectively, to form the clamp members.

Figure 12:
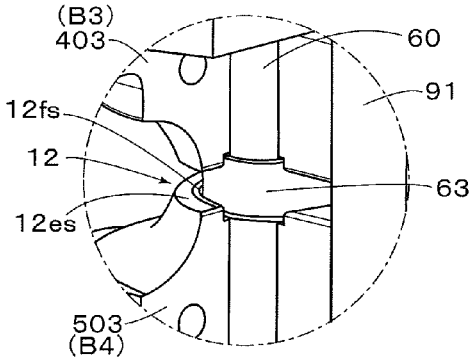
FIG. 12 is a perspective view of a clamp member as shown in FIG. 11, with its fitting recess being enlarged.

According to the fitting recesses 12*xa*, 12*xb* and 12*xc*, with the fitting recess 12*xc* in FIG. 11 being enlarged in FIG. 12, the fitting recess 12 possesses parallel end face areas (12*fs*), where the opposing end faces are parallel to the planar surface perpendicular to the rotary axis (A) (e.g., the planar surfaces parallel to the planar surface including (H) as shown in FIG. 2) in a predetermined distance range including the radially inner end portion, and possesses the width expanding end face areas (12*es*) being continuous with the parallel end face areas (12*fs*), from the rotary axis (A) toward the radial outside, in the same manner as in FIG. 8. The width expanding end face areas (12*es*) as shown in FIG. 12 are formed to be tapered in the same manner as in FIG. 8, and set to be 2-5 degree relative to the planar end face areas (12*fs*), while the width expanding end face areas (12*cs*) of curved surfaces may be formed in the same manner as in FIG. 9. Or, without providing the parallel end face areas (12*fs*), only width expanding end face areas (12*es*, 12*cs*) may be made by forming the tapered surfaces or curved surfaces from the radially inner end portion at the rotary axis (A) toward the radially outer end portion, drawings of which are omitted herein.

Figure 23:
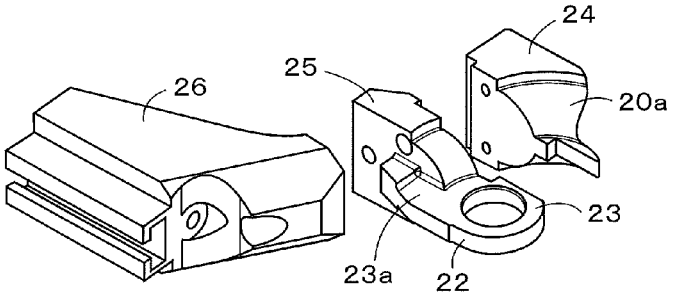
FIG. 23 is a perspective view of parts for assembling a counter pressure member for use in an embodiment of the present invention.

Consequently, in the same manner as the width expanding end face areas (12*es*) as shown in FIGS. 8 and 9, in case of the relative rotating motion between each clamp member 10 (including the clamp member configured by the plurality of members as shown in FIG. 10 and so on) and each counter pressure member 20 (including the counter pressure member configured by the plurality of members as shown in FIG. 23 and so on), a partial sliding motion may be caused between each fitting recess 12 and each fitting protrusion 22, so that a smooth operation can be ensured. In addition, a good oil retention effect can be obtained between each fitting recess 12 and each fitting protrusion 22, so that durability of each clamp member 10 and each counter pressure member 20 will be improved.

Particularly, according to such embodiments as the plurality of bend dies 100*a*, 100*b* and 100*c* being stacked one over another as shown in FIG. 10 and so on, each of the bend dies 100*a*, 100*b* and 100*c* might be applied with a force in such a direction that the rotary shaft (A) will be bent (its central portion will be displaced in a perpendicular direction), so that the width of each fitting recess 12 at its radially outer side may become narrower than its width at the side near the rotary shaft (A) to increase sliding resistance against the fitting protrusion 22. This may be caused similarly (at a different level) even in case of the single bend die 100 as shown in FIG. 8. Therefore, it is necessary to consider a countermeasure to prevent the sliding resistance from being increased. In view of this, the width expanding end face areas (12*es*, 12*cs*) as described before are provided, whereby a partial sliding motion may be caused between each clamp member 10 and each counter pressure member 20, so that durability of them will be improved.

Figure 13:
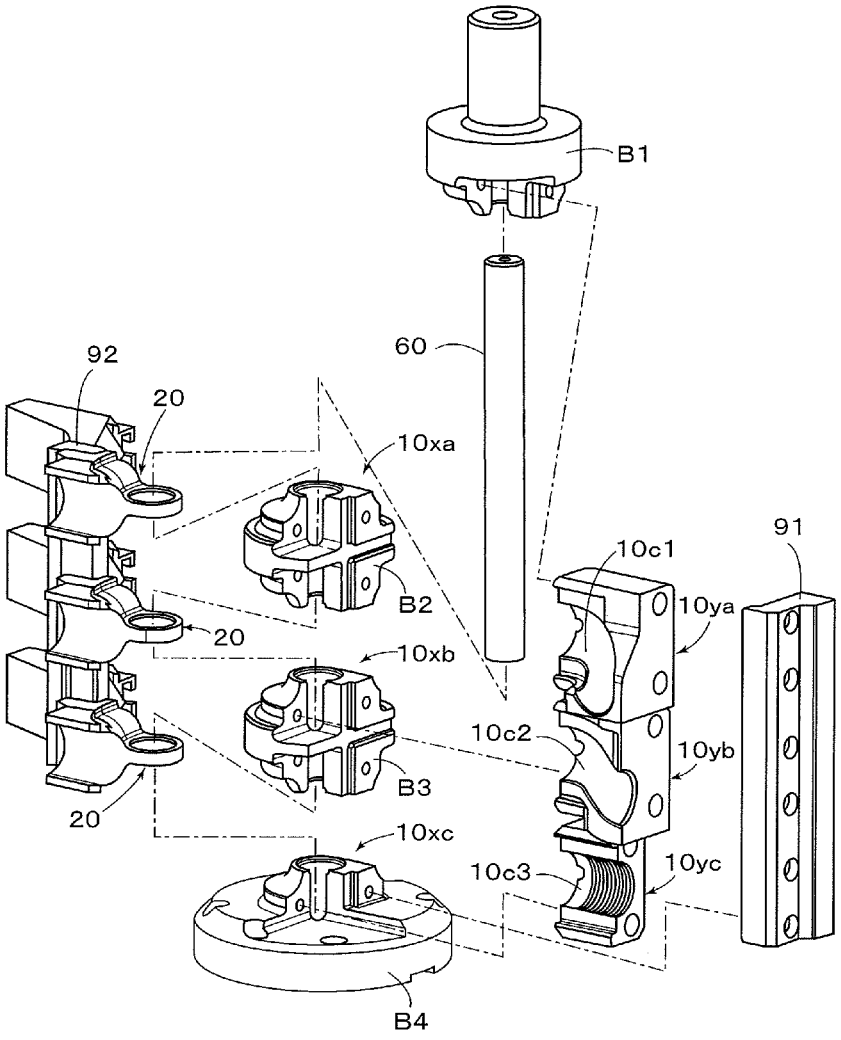
FIG. 13 is a perspective view of a pipe bend die unit according to another embodiment of the present invention.

FIG. 13 shows clamp portions 10*ya*, 10*yb* and 10*yc*, a connecting support member 91 for these clamp portions, three counter pressure members 20, and a connecting support member 92 for the three counter pressure members, in addition to the configuration as shown in FIG. 11. The clamp portions 10*ya*, 10*yb* and 10*yc* are formed with recessed portions 10*c*1, 10*c*2 and 10*c*3, which are formed in shapes in accordance with forming states of the pipe (P) to be clamped, i.e., shapes of portions to be clamped, which configure the end portions of the circularly recessed portions 10*b*1, 10*b*2 and 10*b*3 as mentioned before, respectively.

Figure 14:
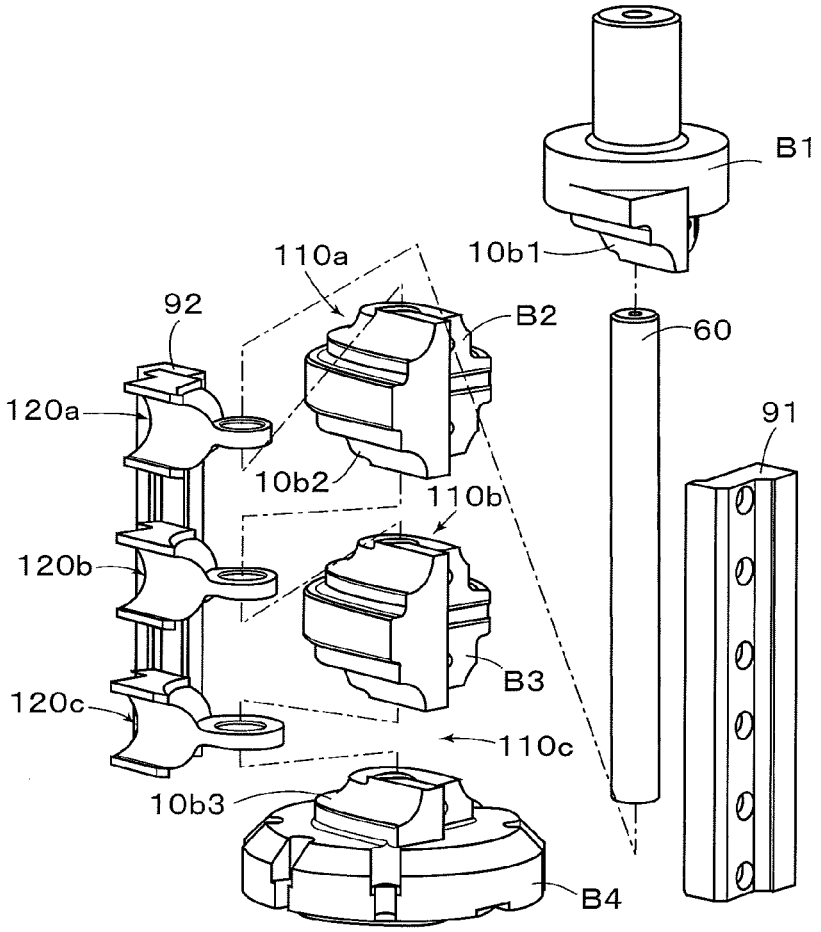
FIG. 14 is a perspective view of parts for assembling a pipe bend die unit according to yet another embodiment of the present invention.

FIG. 14 shows the clamp members 110*a*, 110*b* and 110*c* formed with circularly recessed portions 10*b*1, 10*b*2 and 10*b*3, which are used instead of the main bodies 10*xa*, 10*xb* and 10*xc* of the clamp members as shown in FIGS. 11 and 13, and which are shaped in accordance with bending radii of the pipe (p) to be clamped and/or outer diameters of the pipe (p), and counter pressure members 120*a*, 120*b* and 120*c* formed with fitting protrusions (indicated by "22" in FIG. 4), which are shaped (into different outer diameters) in accordance with bending radii of the pipe (p) and/or outer diameters of the pipe (p). The connecting support members 91 and 92 are the same as shown in FIG. 13.

Figure 15:
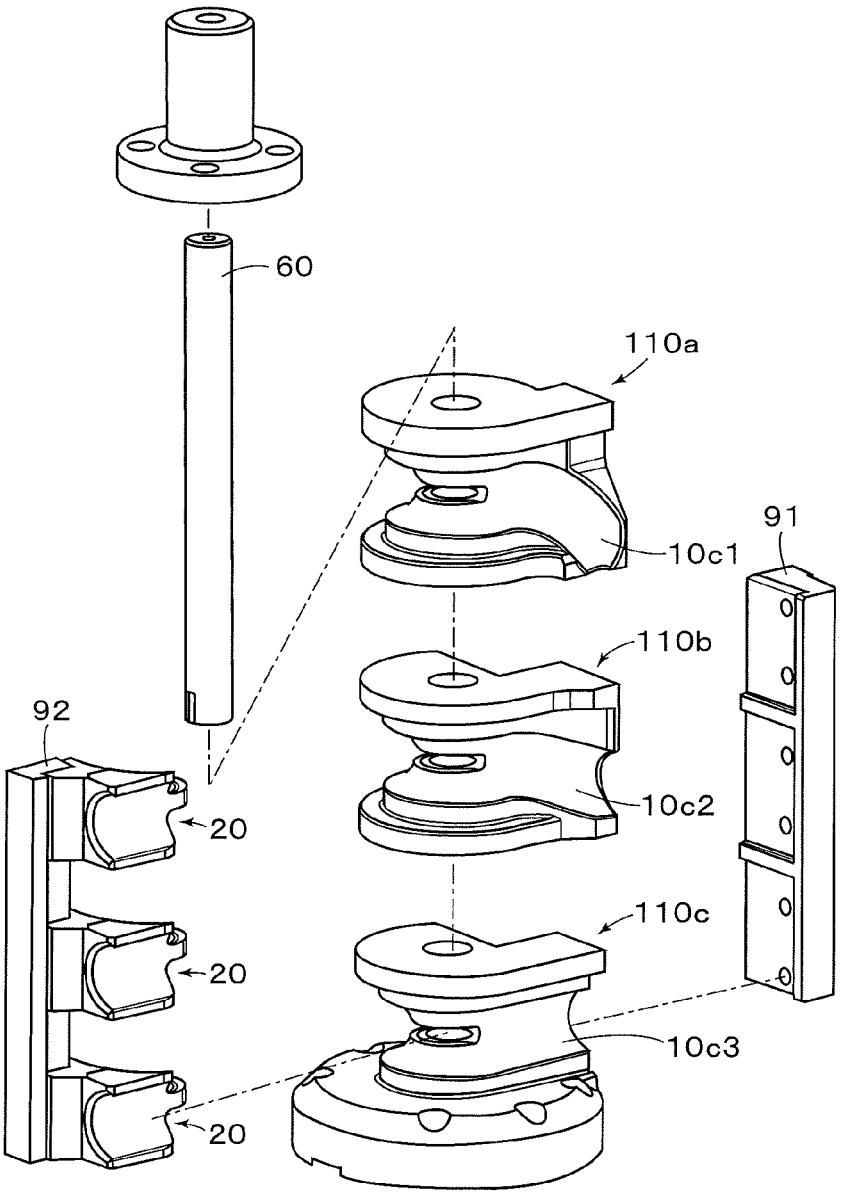
FIG. 15 is a perspective view of parts for assembling a pipe bend die unit according to a further embodiment of the present invention.
Figure 16:
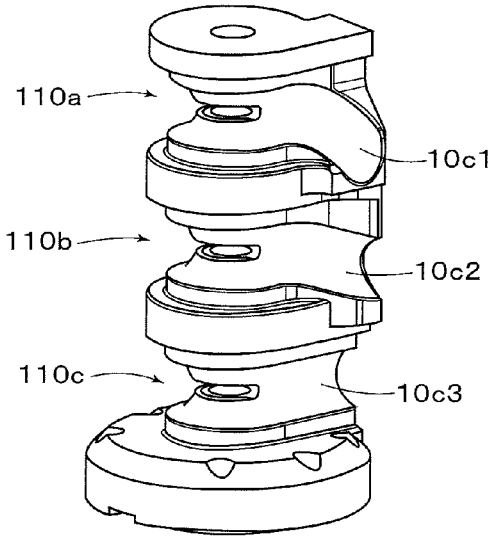
FIG. 16 is a perspective view of another embodiment of a clamp member for use in a further embodiment of the present invention.

FIG. 15 shows that three clamp members 110*a*, 110*b* and 110*c* formed with recessed portions 10*c*1, 10*c*2 and 10*c*3 in shapes selected in accordance with forming states of the pipe (P) to be clamped (in the same manner as shown in FIG. 13) are used, and shows that three counter pressure members 20 fitted into those clamp members are connected to the connecting support member 92. FIG. 16 shows that three clamp members 110*a*, 110*b* and 110*c* formed with the circularly recessed portions in shapes selected in accordance with forming states of the pipe (P) to be clamped (same as shown in FIG. 13) and the connecting support member 91 are connected integrally. Three counter pressure members 20 fitted into the clamp members 110*a*, 110*b* and 110*c* are connected to the connecting support member 92, drawings of which are omitted herein, in the same manner as shown in FIG. 15.

According to the embodiment as shown in FIGS. 17-23, the plurality of bend dies 100*a*, 100*b* and 100*c* are stacked one over another, in the same manner as shown in FIG. 10, and the main bodies 10*xa*, 10*xb* and 10*xc* of three clamp members are configured by four members B1-B4 (and the axial member 60). The main body 10*xa* is configured by an upper section 401 and a lower section 501, the main body 10*xb* is configured by an upper section 402 and a lower section 502, and the main body 10*xc* is configured by an upper section 403 and a lower section 503. The circularly recessed portions 10*b*1, 10*b*2 and 10*b*3 are formed on the main bodies, respectively, in the same manner as shown in FIG. 10. Then, the main bodies 10*xa*, 10*xb* and 10*xc* are connected with the clamp portions 10*ya*, 10*yb* and 10*yc*.

Figure 17:
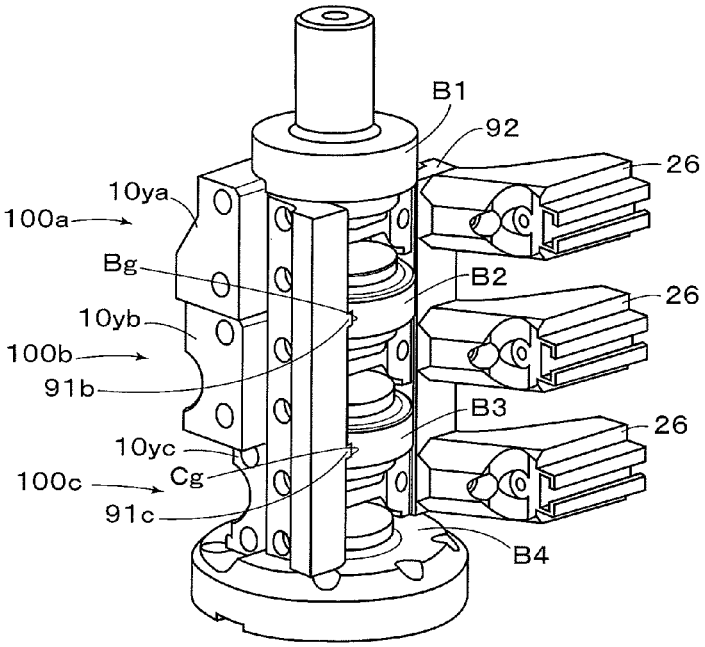
FIG. 17 is a perspective view of a pipe bend die unit according to a yet further embodiment of the present invention.
Figure 18:
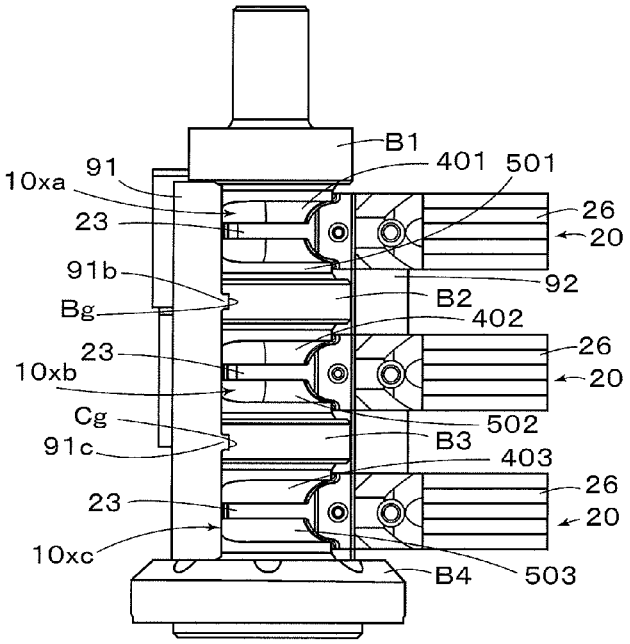
FIG. 18 is a front view of a pipe bend die unit according to a yet further embodiment of the present invention.
Figure 19:
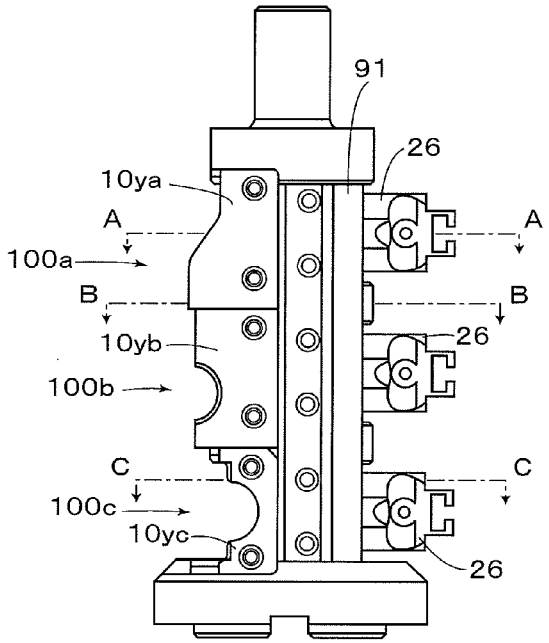
FIG. 19 is a side view of a pipe bend die unit according to a yet further embodiment of the present invention.

As shown in FIGS. 17 and 18, on a tubular portion of the member B2 between the lower section 501 and upper section 402, an engaging groove (Bg) is formed perpendicularly to the rotary axis (A). Also, on a tubular portion of the member B3 between the lower section 502 and upper section 403, an engaging groove (Cg) is formed perpendicularly to the rotary axis (A). And, protrusions 91*b*, 91*c* to be fitted into those grooves are formed on the connecting support member 91. Consequently, the members B1-B4 are connected to the connecting support member 91 by bolts or the like at the opposite sides to the positions of the clamp members, where the bending operation is initiated, and the protrusions 91*b*, 91*c* are fitted into the engaging grooves Bg, Cg, to be firmly held by the so-called spigot joint structure. That is, the members B2 and B3 have the engaging grooves Bg, Cg formed in parallel with the planar surface perpendicular to the rotary axis (A), and the connecting support member 91 has protrusions 91*b*, 91*c* to be engaged with the engaging grooves Bg, Cg, respectively, by which the main bodies 10*xa*, 10*xb* and 10*xc* of the clamp members are firmly held.

Figure 20:
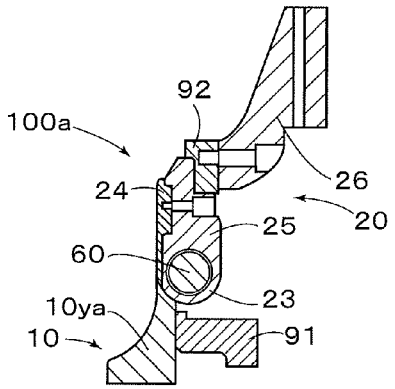
FIG. 20 is a cross sectional view sectioned along A-A line in FIG. 19.
Figure 21:
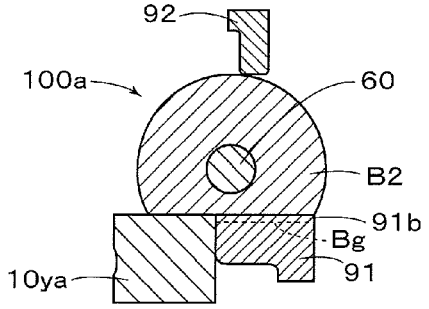
FIG. 21 is a cross sectional view sectioned along B-B line in FIG. 19.
Figure 22:
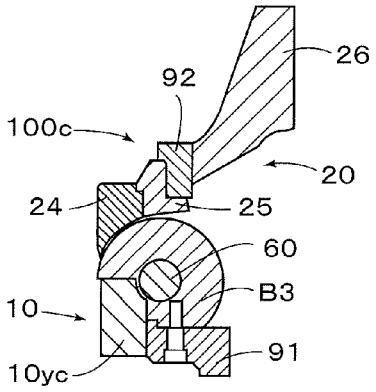
FIG. 22 is a cross sectional view sectioned along C-C line in FIG. 19.

On the contrary, each counter pressure member 20 is connected to the connecting support member 92 by bolts or the like. The connecting support members 91 and 92 may be formed in L-shaped cross section or Z-shaped cross section to increase section modulus, so as to improve rigidity. Each counter pressure member 20 (xa, xb and xc are omitted hereinafter) is divided into parts as shown in FIGS. 20, 22 and 23, and connected with each other by bolts or the like. That is, each counter pressure member 20 has a rotary support portion 23 and main body portion 24, and the rotary support portion 23 is connected to the main body portion 24. As a large load is applied to the rotary support portion 23 through the pipe (P) to be formed, the wear is unavoidable, so that it will be required to replace it after a long term use of it.

In view of the above point, according to the present embodiment, it may be so configured that the counter pressure member 20, which is configured to be connected to a connecting support member 26, is further divided into a first member, which includes mainly the rotary support portion 23 and connecting portion 25, and a second member which includes a part of the rotary support portion 23 and the main body portion 24, and that they are connected by bolts for example, thereby to configure each counter pressure member 20. Consequently, in the case where the rotary support portion 23 of each counter pressure member 20 is worn, only the second member including the worn part may be replaced, so that the replacement is easily made, and that an inexpensive counter pressure member 20, and therefore an inexpensive bend die unit 100, can be provided in view of a long term use of it. The counter pressure member 20 as shown in FIG. 23 is formed with a rib 23*a* to extend from at least a peripheral part of the rotary support portion 23 integrally formed with the main body portion 24, outward in a radial direction of it, to relieve stress concentration applied to a bottom portion of the rotary support portion 23 at a boundary thereof to the curved surface portion 20*a*.

Consequently, according to the embodiment with the plurality of bend dies 100*a*, 100*b* and 100*c* being stacked one over another as described before, when the pipe (P) is bent, such a force that the rotary axis (A) is deflected, i.e., its central portion is displaced in a direction perpendicular to the axis (A), may be applied to the bend dies 100*a*, 100*b* and 100*c*, respectively. However, as the members B1-B4 are connected to the connecting support member 91 by bolts or the like, and firmly held by the so-called spigot joint structure, the deflection, which may be caused on the fitting recess 12 of each clamp member 10, can be prevented appropriately, and the displacement of the width of each clamp member 12 at its outer side in the radial direction can be minimized.

Furthermore, as the members B1-B4 are held by the connecting support member 91 at the opposite sides to the position where the bending operation is initiated, the interference between each counter pressure member 20 and the connecting support member 91 can be avoided at the time of the bending operation. Also, according to the present embodiment, each clamp member 10 is connected to the common connecting support member 91, and each counter pressure member 20 is connected to the common connecting support member 92. Therefore, by means of a single knock pin 80, the initial relative position between each clamp member 10 and each counter pressure member 20 can be easily set, and no adjustment after the die change is needed.

Figure 24:
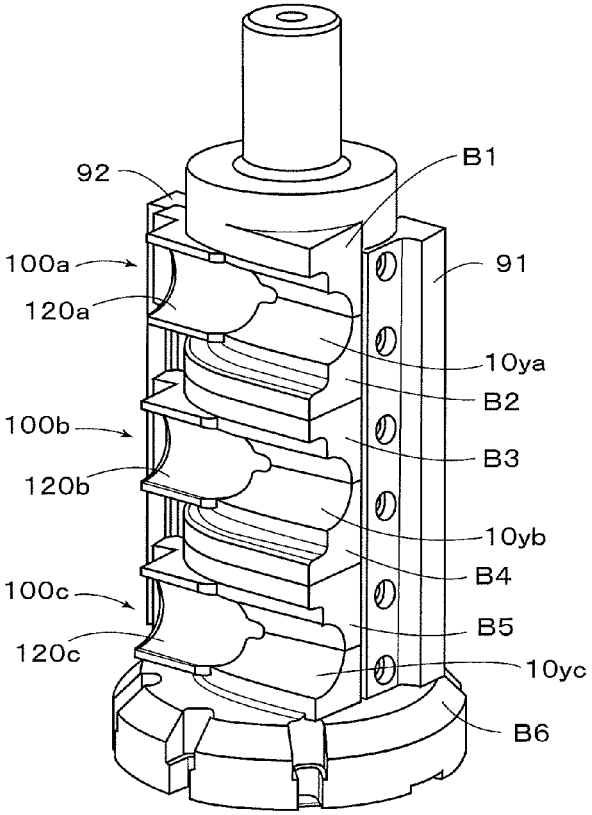
FIG. 24 is a perspective view of a pipe bend die unit according to a yet further embodiment of the present invention.
Figure 25:
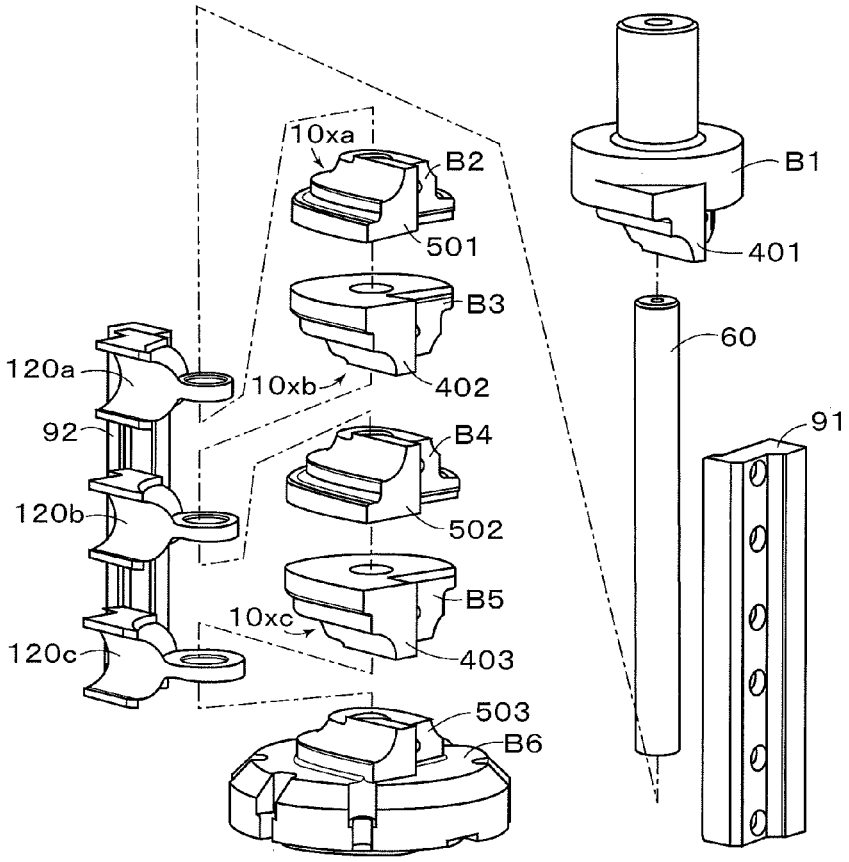
FIG. 25 is a perspective view of parts for assembling a pipe bend die unit according to the embodiment as shown in FIG. 24.

According to the embodiment as shown in FIGS. 24 and 25, the bend dies 100*a*, 100*b* and 100*c* are stacked one over another, and the main bodies 10*xa*, 10*xb* and 10*xc* of three clamp members are configured by six members B1-B6 (and the axial member 60). The main body 10*xa* is configured by the upper section 401 and lower section 501, the main body 10*xb* is configured by the upper section 402 and lower section 502, and the main body 10*xc* is configured by the upper section 403 and lower section 503, with the aforementioned circularly recessed portions 10*b*1, 10*b*2 and 10*b*3 being formed, respectively. And, as shown in FIG. 24, the clamp portions 10*ya*, 10*yb* and 10*yc* are connected to the connecting support member 91, adjacent to the main bodies 10*xa*, 10*xb* and 10*xc*. Also, in the same manner as shown in FIG. 14, three counter pressure members 120*a*, 120*b* and 120*c* are supported by the connecting support member 92, with each counter pressure member being configured as shown in FIG. 4.

Figure 26:
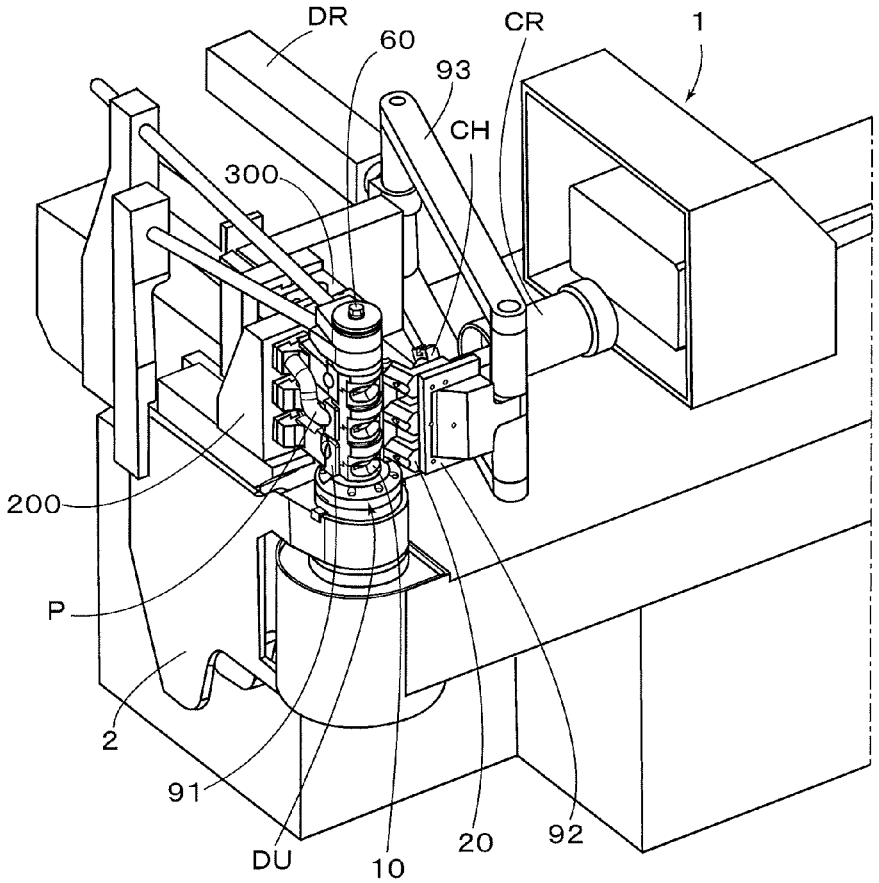
FIG. 26 is a perspective view showing a pipe bending apparatus according to an embodiment of the present invention.

The pipe bending apparatus 1, with the pipe bend die unit of each embodiment being installed on it, is configured as shown in FIG. 26, for example, wherein a pipe chuck (CH) for clamping the pipe (P) to be bent is installed, and a carriage (CR) for moving the pipe (P) forward to apply the axially pressing load is installed. By rotating the pipe chuck (CH), a bending direction of the pipe (P) can be changed, so that three-dimensional bending can be performed. The clamp die 200 is placed on a rotary table 2, by which it is so configured to be rotated about the axial member 60 (rotary axis (A)). And, the pipe bend die unit as indicated by (DU) in FIGS. 17-19 for example, is installed, and it is so configured that the connecting support members 91 and 92 are rotated about the axial member 60, so as to control movement of the three clamp members 10 and counter pressure members 20. According to the present embodiment, the connecting support member 92 is connected to a driving device (DR) through a link 93, so that three counter pressure members 20 are moved simultaneously. However, it may be so configured that the three clamp members 10 and counter pressure members 20 are controlled to be moved separately.

Figure 28:
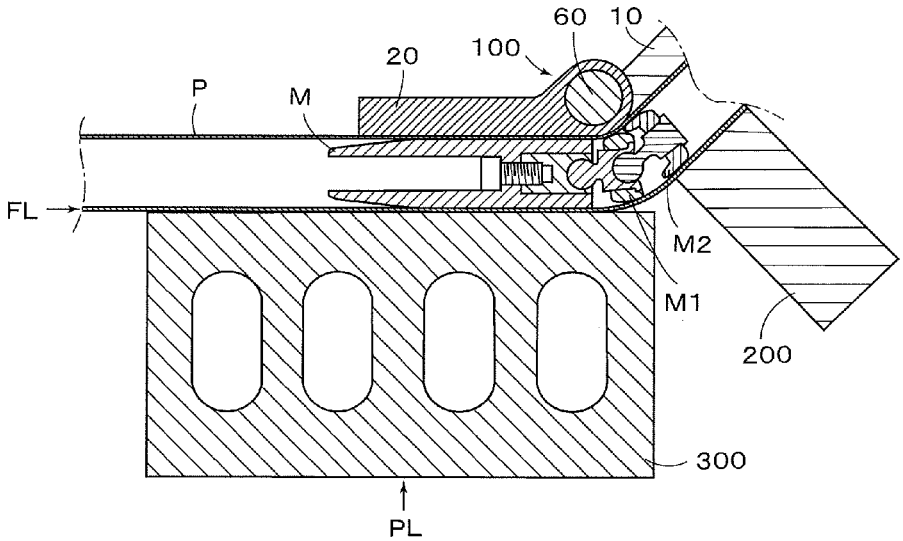
FIG. 28 is a sectional view showing a pipe bending state of a pipe bending apparatus using a pipe bend die unit according to an embodiment of the present invention.

As described above, it is so configured that the bend die 100 of the aforementioned embodiment, especially the counter pressure member 20 hingedly connected to the clamp member 10 functions effectively, so as to be capable of opposing the large load by the pressure die 300 sufficiently. As shown in FIG. 28, axially pressing load (indicated by "FL") and compressing load (indicated by "PL") are applied to the pipe (P). According to the present embodiment, sufficient pressure proof strength against the large load by the pressure die 300 can be ensured, because the clamp member 10 and the counter pressure member 20 are hingedly connected as shown in FIG. 2, such that the fitting portion (F) of the fitting recess 12 fitted with the fitting protrusion 22, which portion (F) is not included in the planar surfaces perpendicular to the rotary axis (A), is located at the foreside in an advancing direction of the pipe (P) relative to the position (S) where the bending operation is initiated, as shown in FIG. 2, and the mating portion (R) of the first groove part 11 of the clamp member 10 and the second groove part 21 of the counter pressure member 20 is located at the backside of the advancing direction of the pipe (P). Furthermore, in such a state that the mandrel (M) (ball mandrels M1 and M2) is inserted into the pipe (P), the compressing load (PL) applied to the pipe (P) can be made larger, so that the bending radius of the pipe (P) can be made minimum.

Figure 29:
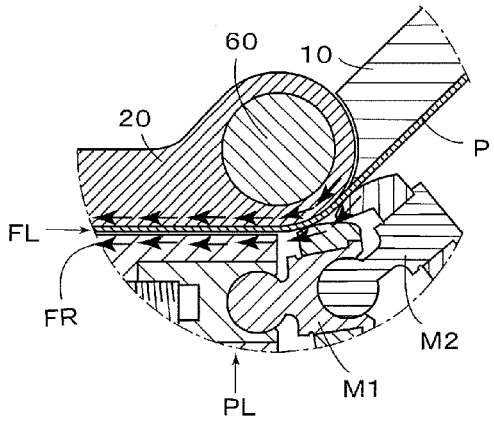
FIG. 29 is a sectional view enlarging a part of FIG. 28.

Also, as enlarged in FIG. 29, in order to avoid reduction of thickness at the outer side of the pipe (P) caused by bending the pipe (P), it is so configured that the axially pressing load (FL) is applied to the pipe (P), so that the pipe (P) is fed with material, thereby to enlarge its thickness. At the inner side of the pipe (P) to be bent, however, a friction force (indicated by a leftward arrow "FR" in FIG. 29) is caused by the compressing load (PL) against the axially pressing load (FL), so that the thickness will be increased by that friction force (FR). Furthermore, if the axially pressing load (FL) is applied in the state that the mandrel (M) has been inserted into the pipe (P), the pipe (P) is advanced (moved to the rightward in FIG. 29) in such a state as being compressed between the mandrel (M) and the counter pressure member 20, so that the thickness will be more largely increased, with squeezing operation being added by both of the members.

Figure 30:
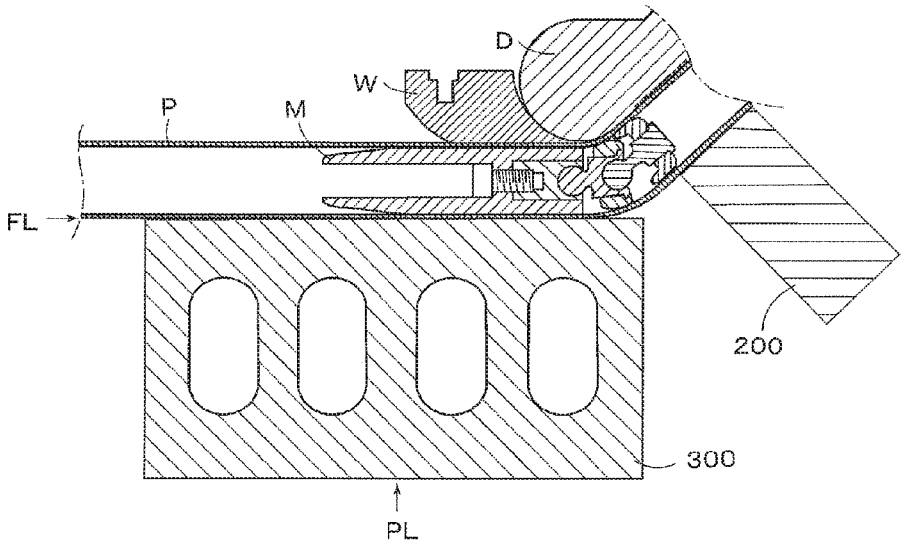
FIG. 30 PRIOR ART
FIG. 30 is a sectional view showing a pipe bending state of a rotary drawing bend apparatus having a prior bend die and a wiper.

In contrast, according to the rotary bending apparatus using the prior bend die and wiper for preventing the crinkling, it is arranged in such a manner that the wedge shaped wiper (W) will squeeze into a clearance between the pipe (P) and bend die (D) as shown in FIG. 30, the tip end of the wiper (W) is made extremely thin, so as to reduce the clearance between the pipe (P) and wiper (W) as small as possible, so that the wiper (W) is likely to be fragile. Therefore, if the large load by the pressure die 300 is continuously applied to the wiper (W), its tip end will be deformed or destroyed, to enlarge the clearance between the same and the pipe (P), thereby to cause the crinkling. In order to avoid the crinkling, it is required to maintain the extremely thin tip end of the wiper (W), so that a periodical change of the wiper (W) and a change for a destroyed one have been necessarily required. Also, as the pipe is bent to avoid the crinkling from being caused, the radius of the pipe (P) to be bent is limited, so that the maximum radius of the pipe (P) to be made will be approximately 2 of the aforementioned r/d ratio, at most.

Figure 31:
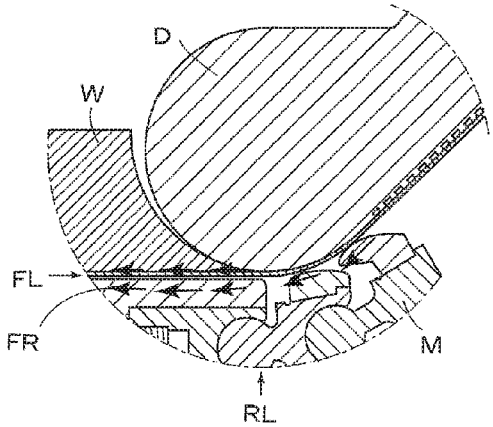
FIG. 31 PRIOR ART
FIG. 31 is a sectional view enlarging a part of FIG. 30.

According to the prior rotary bending apparatus, although the bending of the pipe (P) is performed in the state that the mandrel (M) has been inserted into the pipe (P), and the friction force (FR) is caused as shown in FIG. 31, no sliding motion is made between the pipe (P) and bend die (D) basically, but a following motion of the pipe (P) is made in response to rotating motion of the bend die (D), so that increase of the thickness cannot be expected by the friction force (FR). FIGS. 30 and 31 are prepared to simply show operation and effect according to the prior art, to be compared with the operation and effect according to the present invention using the pipe bend die unit. FIGS. 30 and 31 are not intended to imply that such known apparatuses are comparable to the pipe bend die unit of the present invention.

DESCRIPTION OF CHARACTERS

10, 110*a*, 110*b*, 110*c* clamp member
10*b*, 10*b*1, 10*b*2, 10*b*3 circularly recessed portion
10*x*, 10*xa*, 10*xb*, 10*xc* main body
10*y*, 10*ya*, 10*yb*, 10*yc* clamp portion
11, 11*a*, 11*b* first groove part
12, 12*xa*, 12*xb*, 12*xc* fitting recess
13 base portion
20, 120*a*, 120*b*, 120*c* counter pressure member
21 second groove part
22 fitting protrusion
23 rotary support portion
26 support member
30 base
40, 401, 402, 403 upper section
50, 501, 502, 503 lower section
60 axial member
70 holding member
80 knock pin
91, 92 connecting support member
100, 100*a*, 100*b*, 100*c* bend die
200 clamp die
300 pressure die
A rotary axis
P pipe
M mandrel

The invention claimed is:

1. A pipe bend die unit comprising a bend die with a pipe-receiving groove of half-circular cross section formed on an outer peripheral surface of the bend die, the bend die being rotatable about a rotary axis, and the bend die comprising:

a clamp member having a pipe-receiving first groove part of half-circular cross section on an outer peripheral surface of the clamp member with a fitting recess formed on the first groove part and extending in a peripheral direction by a first predetermined length on a planar surface perpendicular to the rotary axis; and a counter pressure member having a pipe-receiving second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the fitting recess of the clamp member possessing opposing end faces in width expanding end face areas that intersect the pipe-receiving first groove part, where a clearance between the end faces of the fitting recess is enlarged in a predetermined distance range including at least a radially outer end portion, from the rotary axis toward a radial outside, and the counter pressure member and the clamp member being hingedly connected to one another about the rotary axis, and supported so as to be rotatable relative to each other about the rotary axis.

2. The pipe bend die unit of claim 1, wherein one part of the fitting protrusion is located at a foreside in an advancing direction of the pipe relative to a position where a bending operation of the pipe is initiated, and an other part of the fitting protrusion is located at a backside in the advancing direction of the pipe relative to the position where the bending operation of the pipe is initiated.

3. The pipe bend die unit of claim 1, wherein a fitting portion of the fitting protrusion that is positioned in the fitting recess is located at a foreside in an advancing direction of the pipe relative to a position where a bending operation of the pipe is initiated, and a mating portion at which the first groove part of the clamp member and the second groove part of the counter pressure member mate is located at a backside in the advancing direction of the pipe relative to the position where the bending operation of the pipe is initiated.

4. The pipe bend die unit of claim 1, wherein the counter pressure member has an annular rotary support portion mounted to be rotatable about the rotary axis, and wherein a part of the rotary support portion forms the fitting protrusion, and the rotary support portion possesses an outer peripheral surface, the outer peripheral surface of the rotary support portion being a curved surface forming a part of the pipe-receiving groove of half-circular cross section.

5. The pipe bend die unit of claim 1, wherein the counter pressure member and the clamp member are hingedly connected by an axial member having a central axis passing through the fitting recess.

6. The pipe bend die unit of claim 1, wherein the fitting recess of the clamp member possesses opposing end faces in parallel end face areas, where the end faces in the parallel end face areas are parallel to the planar surface perpendicular to the rotary axis in a predetermined distance range including a radially inner end portion, and possesses the width expanding end face areas being continuous with the parallel end face areas, from the rotary axis toward the radial outside.

7. The pipe bend die unit of claim 6, wherein the width expanding end face areas are inclined by 2-5 degree relative to the planar surface perpendicular to the rotary axis.

8. The pipe bend die unit of claim 1, wherein the fitting protrusion of the counter pressure member possesses a contact surface contacting with the pipe, the contact surface having a width included within a range of 20-45 degree about the central axis of the pipe as viewed on a cross section perpendicular to the central axis of the pipe, when the pipe is positioned in the first groove part of half-circular cross section of the clamp member.

9. The pipe bend die unit of claim 1, wherein a plurality of bend dies are stacked one over another about the rotary axis as a common axis, and the pipe bend die unit comprises a connecting support member for holding each of the plurality of bend dies on a planar surface parallel to the rotary axis.

10. The pipe bend die unit of claim 9, wherein the plurality of bend dies comprise a plurality of members, at least two members of the plurality of members having engaging grooves parallel to the planar surface perpendicular to the rotary axis, and wherein the connecting support member has protrusions to be engaged with the engaging grooves, the plurality of bend dies being held, with the protrusions being engaged with the engaging grooves.

11. The pipe bend die unit of claim 9, wherein the first groove part formed on each clamp member of the plurality of bend dies possesses a sectional view formed to be different from each other depending upon forming states of the pipe.

12. A pipe bending apparatus comprising:

a bend die having a groove of half-circular cross section on an outer peripheral surface of the bend die, the bend die being rotatable about a rotary axis;

a clamp die for clamping a pipe to be bent with the groove of the bend die; and a pressure die for pressing the pipe toward the bend die, wherein the bend die comprises:

a clamp member having a pipe-receiving first groove part of half-circular cross section on an outer peripheral surface of the clamp member with a fitting recess formed on the first groove part and extending in a peripheral direction by a first predetermined length on a planar surface perpendicular to the rotary axis; and a counter pressure member having a pipe-receiving second groove part of half-circular cross section formed on an outer peripheral surface of the counter pressure member, and a fitting protrusion extending in a peripheral direction by a second predetermined length from a tip end portion of the second groove part, the fitting protrusion being positioned in the fitting recess so that the first and second groove parts combine to form the pipe-receiving groove of half-circular cross section, the fitting recess of the clamp member possessing opposing end faces in width expanding end face areas that intersect the first groove part, where a clearance between the end faces of the fitting recess is enlarged in a predetermined distance range including at least a radially outer end portion, from the rotary axis toward a radial outside, and the counter pressure member and the clamp member being hingedly connected to one another about the rotary axis, and supported so as to be rotatable relative to each other about the rotary axis, to configure a pipe bend die unit.

13. The pipe bending apparatus of claim 12, wherein one part of the fitting protrusion is located at a foreside in an advancing direction of the pipe relative to a position where a bending operation of the pipe is initiated, and another part of the fitting protrusion is located at a backside in the advancing direction of the pipe relative to the position where the bending operation of the pipe is initiated.

14. The pipe bending apparatus of claim 12, wherein a fitting portion of the fitting protrusion that is positioned in the fitting recess is located at a foreside in an advancing direction of the pipe relative to a position where a bending operation of the pipe is initiated, and a mating portion at which the first groove part of the clamp member and the second groove part of the counter pressure member mate is located at a backside in the advancing direction of the pipe relative to the position where the bending operation of the pipe is initiated.

15. The pipe bending apparatus of claim 12, wherein the counter pressure member has an annular rotary support portion mounted to be rotatable about the rotary axis, and a body portion formed integrally with the rotary support portion, the second groove part of half-circular cross section being provided on the body portion, a part of the rotary support portion being formed integrally with the body portion and extending outwardly in a radial direction of the rotary support portion, and wherein the rotary support portion forms the fitting protrusion, and the rotary support portion possesses an outer peripheral surface, the outer peripheral surface of the rotary support portion being a curved surface forming a part of the pipe-receiving groove of half-circular cross section.

16. The pipe bending apparatus of claim 12, wherein the fitting recess of the clamp member possesses opposing end faces in parallel end face areas, where the end faces in the parallel end face areas are parallel to the planar surface perpendicular to the rotary axis in a predetermined distance range including a radially inner end portion, and possesses the width expanding end face areas being continuous with the parallel end face areas, from the rotary axis toward the radial outside.

17. The pipe bending apparatus of claim 12, wherein a plurality of bend dies are stacked one over another about the rotary axis as a common axis, and the pipe bend die unit comprises a connecting support member for holding each of the plurality of bend dies on a planar surface parallel to the rotary axis.

18. The pipe bending apparatus of claim 17, wherein the plurality of bend dies comprise a plurality of members, at least two members of the plurality of members having engaging grooves parallel to the planar surface perpendicular to the rotary axis, and wherein the connecting support member has protrusions to be engaged with the engaging grooves, the plurality of bend dies being held, with the protrusions being engaged with the engaging grooves.

19. The pipe bending apparatus of claim 17, wherein the first groove part formed on each clamp member of the plurality of bend dies possesses a sectional view formed to be different from each other depending upon forming states of the pipe.

20. The pipe bending apparatus of claim 12, further comprising a mandrel with a tip end portion thereof being inserted into the pipe, the mandrel being driven such that the tip end portion opposes the pressure die within a predetermined rotating region of the bend die.

* * * * *